US006374910B2

(12) United States Patent
Tsunoda et al.

(10) Patent No.: US 6,374,910 B2
(45) Date of Patent: Apr. 23, 2002

(54) HEAT EXCHANGER

(75) Inventors: Tadashi Tsunoda; Tokiyuki Wakayama; Fumihiko Shikano, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/341,698

(22) PCT Filed: Jan. 23, 1998

(86) PCT No.: PCT/JP98/00270

§ 371 Date: Jul. 26, 1999

§ 102(e) Date: Jul. 26, 1999

(87) PCT Pub. No.: WO98/33030

PCT Pub. Date: Jul. 30, 1998

(30) Foreign Application Priority Data

Jan. 27, 1997 (JP) ..... 9-012961
Jan. 27, 1997 (JP) ..... 9-012962
Jan. 27, 1997 (JP) ..... 9-012963

(51) Int. Cl.[7] ..... F28F 3/00
(52) U.S. Cl. ..... 165/166; 165/166
(58) Field of Search ..... 165/165, 166, 165/165 B, DIG. 399

(56) References Cited

U.S. PATENT DOCUMENTS 2,828,946 A * 4/1958 Smith ..... 165/166
3,403,724 A * 10/1968 Gutkowski ..... 165/166
4,043,388 A * 8/1977 Zebuhr ..... 165/166
4,343,355 A * 8/1982 Goloff et al. ..... 165/166
4,396,057 A * 8/1983 Berntell et al. ..... 165/166
4,527,622 A * 7/1985 Weber ..... 165/166
4,805,695 A * 2/1989 Ishikawa et al. ..... 165/166
5,469,914 A 11/1995 Davison et al.

FOREIGN PATENT DOCUMENTS

EP 0 018 745 A1 11/1980
EP 0 071 781 A1 2/1983
EP 0 492 799 A1 7/1992

OTHER PUBLICATIONS

International Publication No. WO 97/21062, published Jun. 12, 1997.
International Publication No. WO 97/37187, published Oct. 9, 1977.

* cited by examiner

*Primary Examiner*—Henry Bennett
*Assistant Examiner*—Tho Van Duong
(74) *Attorney, Agent, or Firm*—Arent Fox Kintner Plotkin & Kahn

(57) ABSTRACT

Ends of heat-transfer plates S1, S2, formed by bending folding plate blanks in a zigzag fashion along folding lines $L_1$, $L_2$, are cut in an angle shape, and flange portions 26 formed by folding apexes of the angle shape are superposed one on another and brazed in a surface contact state, thereby to form combustion gas passage inlets 11 and air passage outlets 16 along the two end edges of the angle shapes. Compared with brazing of separate flange members onto the cut surfaces of the apexes of the angle shapes, this fabrication not only dispenses with precise finishing of the cut surfaces, but also serves to increase the brazing strength.

6 Claims, 20 Drawing Sheets

5/20

L1
S1
L1
S2
L1
L1
6
L1
4
5
6
23
22
SMALL PITCH
MEDIUM PITCH
LARGE PITCH
L2
L2
L2
7

HEAT EXCHANGER

FIELD OF THE INVENTION

The present invention relates to a heat exchanger including high-temperature fluid passages and low-temperature fluid passages defined alternately by alternately disposing a plurality of first heat-transfer plates and a plurality of second heat-transfer plates.

BACKGROUND ART

Such heat exchangers have already been proposed in Japanese Patent Application Nos.7-193208 and 8-275057 filed by the applicant of the present invention.

The above conventional heat exchangers suffer from the following problem: The partitioning between a high-temperature fluid passage inlet and a low-temperature fluid passage outlet and the partitioning between a low-temperature fluid passage inlet and a high-temperature fluid passage outlet are achieved by bonding a partition plate by brazing to a cut surface formed on the heat-transfer plate by cutting its angle-shaped apex portion. For this reason, the bonded portions of the cut surface of the heat-transfer plate and the partition plate are in line contact with each other. To reliably perform the brazing, the precise finishing of the cut surface is required, and moreover, even if the finishing is performed, it is still difficult to provide a sufficient bonding strength.

The above conventional heat exchangers also suffer from the following other problem: axially opposite ends of the heat-transfer plate are cut into angle shapes to define the fluid passage inlet and outlet. Therefore, a drifting flow of fluid is generated from the outer side toward the inner side as viewed in a turning direction due to a difference between the lengths of flow paths on the inner and outer sides as viewed in the turning direction in a region where a fluid flowing into the heat exchanger obliquely with respect to an axis in the vicinity of the fluid passage inlet is turned in the direction along the axis, and in a region where the fluid flowing in the direction along the axis is turned in an inclined direction with respect to the axis in the vicinity of the fluid passage outlet. For this reason, the flow rate on the outer side as viewed in the turning direction is decreased, while the flow rate on the inner side as viewed in the turning direction is increased, whereby the heat exchange efficiency is reduced due to the non-uniformity of the flow rate.

The above conventional heat exchanger is formed into an annular shape by folding a folding plate blank in a zigzag fashion to fabricate modules each having a center angle of 90° and combining four of the modules in a circumferential direction. However, if the heat exchanger is formed by combination of a plurality of modules, the following problems arise: the number of parts is increased, and moreover, four bonded points among the modules are produced, and the possibility of leakage of the fluid from the bonded portions is correspondingly increased.

DISCLOSURE OF THE INVENTION

The present invention has been accomplished with the above circumstances in view, and it is a first object of the present invention to ensure that a sufficient bonding strength is provided without a precise finishing of the ends of the heat-transfer plate. It is a second object of the present invention to suppress of a drifting flow of a fluid generated at fluid-direction changing portions in the vicinity of the fluid passage inlet and outlet of the heat exchanger thereby to prevent a reduction in heat exchange efficiency. It is a third object of the present invention to decrease the number of parts of the heat exchanger and to maintain the leakage of the fluid from the bonded portions of the folding plate blank to the minimum.

To achieve the above object, according to a first aspect and feature of the present invention, there is provided a heat exchanger, comprising a plurality of first heat-transfer plates and a plurality of second heat-transfer plates disposed radiately in an annular space defined between a radially outer peripheral wall and a radially inner peripheral wall, and a high-temperature fluid passage and a low-temperature fluid passage which are defined circumferentially alternately between adjacent ones of the first and second heat-transfer plates by bonding pluralities of projections formed on the first and second heat-transfer plates to one another, axially opposite ends of each of the first and second heat-transfer plates being cut into angle shapes each having two end edges, thereby defining a high-temperature fluid passage inlet by closing one of the two end edges and opening the other end edge at axially one end of the high-temperature fluid passage, defining a high-temperature fluid passage outlet by closing one of the two end edges and opening the other end edge at the axially other end of the high-temperature fluid passage, defining a low-temperature fluid passage outlet by opening one of the two end edges and closing the other end edge at axially one end of the low-temperature fluid passage, and defining a low-temperature fluid passage inlet by opening one of the two end edges and closing the other end edge at the axially other end of the low-temperature fluid passage, characterized in that flange portions formed by folding one of apex portions of the angle shape are superposed one on another and bonded together, whereby the high-temperature fluid passage inlet and the low-temperature fluid passage outlet are partitioned from each other by the superposed flange portions, and further flange portions formed by folding the other apex portion of the angle shape are superposed one on another and bonded together, whereby the high-temperature fluid passage outlet and the low-temperature fluid passage inlet are partitioned from each other by the superposed further flange portions.

With the above arrangement, in the annular heat exchanger in which the fluid passage inlets and outlets are defined by cutting the axially opposite ends of the heat-transfer plates into angle shapes, the flange portions formed by folding the apex portions of the angle shape are superposed one on another and bonded together, whereby the fluid passage inlet and outlet are partitioned from each other by bonding a partition plate to the superposed flange portions. Therefore, as compared with the case where a partition plate is bonded in a line contact state to the cut surfaces formed by cutting the heat-transfer plates, the superposed flange portions can be bonded together in a surface contact state, thereby not only increasing the bonding strength, but also eliminating the need for a precise finishing of the cut surfaces. Therefore, the bonding of the projections on the heat-transfer plates and the bonding of the flange portions can be accomplished in a continuous flow, leading to a reduction in processing cost.

If a folding plate blank including the first and second heat-transfer plates which are alternately connected together through first and second folding lines is folded in a zigzag fashion along the first and second folding lines, and portions corresponding to the first folding lines are bonded to the radially outer peripheral wall, while portions corresponding to the second folding lines are bonded to the radially inner peripheral wall, the number of parts can be reduced, and moreover, the misalignment of the first and second heat-transfer plates can be prevented to enhance the processing precision, as compared with the case where the first and second heat-transfer plates are formed from different materials and bonded to each other.

If the flange portions are folded into an arcuate shape and superposed one on another, and the height of projection stripes formed along angle-shaped end edges of the first and second heat-transfer plates is gradually decreased in the flange portions in order to close the fluid passage inlets and outlets, it is possible to prevent a gap from being produced between the projection stripes, while preventing the mutual interference of the projection stripes abutting against one another at the flange portions to enhance the sealability to the fluid.

To achieve the first object, according to a second aspect and feature of the present invention, there is provided a heat exchanger, comprising a plurality of first heat-transfer plates and a plurality of second heat-transfer plates which are formed into a rectangular shape, and a high-temperature fluid passage and a low-temperature fluid passage which are defined alternately between adjacent ones of the first and second heat-transfer plates by bonding a pair of long sides of each of the first and second heat-transfer plates to a first bottom wall and a second bottom wall, bonding a pair of short sides of each of the first and second heat-transfer plates to a first end wall and a second end wall, and further bonding a plurality of projections formed on the first and second heat-transfer plates to one another, a high-temperature fluid passage inlet and a high-temperature fluid passage outlet which are defined in the first bottom wall so as to extend along the first and second end walls, respectively and which are connected to the high-temperature fluid passage, and a low-temperature fluid passage inlet and a low-temperature fluid passage outlet which are defined in the second bottom wall so as to extend along the first and second end walls, respectively and which are connected to the low-temperature fluid passage, characterized in that flange portions formed by folding the pair of short side portions are superposed one on another and bonded together, and the first and second end walls are bonded to the superposed flange portions, respectively.

With the above arrangement, in the rectangular parallelepiped heat exchanger in which the pair of long sides of the pluralities of the heat-transfer plates formed into the rectangular shape are bonded to the bottom walls, respectively, while the pair of short sides are bonded to the end walls, respectively, and the fluid passage inlets and outlets are defined at longitudinally opposite ends of the bottom walls, the flange portions formed by folding the short sides of the heat-transfer plates are superposed one on another and bonded together, and the fluid passage inlet and outlet are partitioned from each other by bonding the superposed flange portions to the end wall. Therefore, as compared with the case where the end walls are bonded in a line contact state to end surfaces formed by cutting the heat-transfer plates, the superposed flange portions can be bonded in a surface contact state to one another, thereby not only increasing the bonding strength, but also eliminating the need for a precise finishing of the cut surfaces. Therefore, the bonding of the projections on the heat-transfer plates and the bonding of the flange portions can be accomplished in a continuous flow, leading to a reduction in processing cost.

If a folding plate blank including the first and second heat-transfer plates which are alternately connected together through the first and second folding lines is folded in a zigzag fashion along the first and second folding lines, and portions corresponding to first folding lines are bonded to the first bottom wall, while portions corresponding to the second folding lines are bonded to the second bottom wall, the number of parts can be reduced, and moreover, the misalignment of the first and second heat-transfer plates can be prevented to enhance the processing precision, as compared with the case where the first and second heat-transfer plates are formed from different materials and bonded to each other.

To achieve the second object, according to a third aspect and feature of the present invention, there is provided a heat exchanger, comprising a plurality of first heat-transfer plates and a plurality of second heat-transfer plates which are disposed radiately in an annular space defined between a radially outer peripheral wall and a radially inner peripheral wall, whereby a high-temperature fluid passage and a low-temperature fluid passage are defined alternately in a circumferential direction between adjacent ones of the first and second heat-transfer plates, axially opposite ends of the first and second heat-transfer plates being cut into an angle shape each having two end edges, respectively, thereby defining a high-temperature fluid passage inlet by closing one of the two end edges and opening the other end edge at axially one end of the high-temperature fluid passage, defining a high-temperature fluid passage outlet by closing one of the two end edges and opening the other end edge at the axially other end of the high-temperature fluid passage, defining a low-temperature fluid passage outlet by opening one of the two end edges and closing the other end edge at axially one end of the low-temperature fluid passage, and defining a low-temperature fluid passage inlet by opening one of the two end edges and closing the other end edge at the axially other end of the low-temperature fluid passage, and tip ends of large numbers of projections formed on opposite surfaces of the first and second heat-transfer plates being bonded together, characterized in that a pitch of arrangement of the projections is different between the axially opposite ends and an axially intermediate portion of each of the first and second heat-transfer plates.

With the above arrangement, in the annular heat exchanger in which the fluid passage inlets and outlets are defined by cutting the axially opposite ends of the heat-transfer plates into the angle shape, the pitch of arrangement of the projections formed on the heat-transfer plate is different between the axially opposite ends and the axially intermediate portion of the heat-transfer plate. Therefore, it is possible to prevent a drifting flow from being produced at a fluid-direction changing portion to provide an enhancement in heat exchange efficiency and a reduction in pressure loss, by changing the fluid flow resistance in the vicinity of the fluid passage inlets and outlets by the projections.

In areas facing the inlets and outlets of the high-temperature fluid passage and the low-temperature fluid passage, if the pitch of arrangement of the projections in a direction substantially perpendicular to the direction of flowing of fluid passed through the inlets and outlets is dense in an area portion nearer to a base end portion of the angle shape and sparse in an area portion nearer to the tip end portion, the flow resistance on a radially inner side of the direction-changing portion where the fluid is easy to flow because of the short flow path can be increased by the dense arrangement of the projections, and the flow resistance on a radially outer side of the direction-changing portion where the fluid is difficult to flow because of the long flow path can be decreased by the sparse arrangement of the projections, thereby preventing a drifting flow from being produced in the fluid-direction changing portion to provide an enhancement in heat exchange efficiency and a reduction in pressure loss.

If the pitch of arrangement of the projections of the first and second heat-transfer plates is set such that the unit number of heat transfer is substantially constant in a radial direction at an axially intermediate portion of each of the first and second heat-transfer plates, it is possible to radially uniformize the profile of temperature of the heat-transfer plate to avoid the reduction in heat exchange efficiency and the generation of undesirable thermal stress. When the heat transfer coefficient of each of the first and second heat-transfer plates is represented by K; the area of each of the first and second heat-transfer plates is represented by A; the specific heat of the fluid is represented by C; and the mass flow rate of the fluid flowing in the heat transfer area is represented by dm/dt, the unit amount $N_{tu}$ of heat transfer is defined by the following equation:

$$N_{tu}=(K\times A)/[C\times(dm/dt)]$$

If the projections are arranged at the axially intermediate portion of each of the first and second heat-transfer plates, so that they are not lined up in the direction of flowing of the fluid passed through the axially intermediate portion, the fluid is agitated sufficiently by the projections, leading to an enhanced heat exchange efficiency.

To achieve the second object, according to a fourth aspect and feature of the present invention, there is provided a heat exchanger, comprising a plurality of first heat-transfer plates and a plurality of second heat-transfer plates which are formed into a rectangular shape, and disposed in parallel, so that a pair of long sides thereof are bonded to a first bottom wall and a second bottom wall and a pair of short sides thereof are bonded to a first end wall and a second end wall, thereby defining high-temperature fluid passage and low-temperature fluid passage alternately between adjacent ones of the first and second heat-transfer plates, a high-temperature fluid passage inlet and a high-temperature fluid passage outlet which are defined in the first bottom wall so as to extend along the first and second end walls, respectively and which are connected to the high-temperature fluid passage, and a low-temperature fluid passage inlet and a low-temperature fluid passage outlet which are defined in the second bottom wall so as to extend along the second and first end walls, respectively and which are connected to the low-temperature fluid passage, and large numbers of projections formed on opposite surfaces of the first and second heat-transfer plates and bonded together at tip ends of the projections, characterized in that the pitch of arrangement of the projections is different between longitudinally opposite ends and a longitudinally intermediate portion of each of the first and second heat-transfer plates.

With the above arrangement, in the rectangular parallelepiped heat exchanger in which the fluid passage inlets and outlets are defined at the longitudinally opposite sides of the rectangular heat-transfer plates, the pitch of arrangement of the projections formed on each of the heat-transfer plates is different between the longitudinally opposite ends and the longitudinally intermediate portion of the heat-transfer plate. Therefore, when the fluid is turned in the vicinity of the fluid passage inlet and outlet, the fluid flow resistance can be controlled by the projections to prevent the generation of a drifting flow directed inwards in the turning direction to provide an enhancement in heat exchange efficiency and a reduction in pressure loss.

In areas facing the high-temperature and low-temperature fluid passage inlets and outlets, if the pitch of arrangement of the projections in the direction substantially perpendicular to the direction of flowing of the fluid passed through the inlets and outlets is dense in an area portion farther from the first and second end walls and is sparse in an area portion nearer to the first and second end walls, the flow resistance on a radially inner side of the direction-changing portion where the fluid is easy to flow because of the short flow path can be increased by the dense arrangement of the projections, and the flow resistance on a radially outer side of the direction-changing portion where the fluid is difficult to flow because of the long flow path can be decreased by the sparse arrangement of the projections, thereby preventing a drifting flow from being produced in the fluid-direction changing portion to provide an enhancement in heat exchange efficiency and a reduction in pressure loss.

To achieve the third object, according to a fifth aspect and feature of the present invention, there is provided a heat exchanger, comprising a plurality of first heat-transfer plates and a plurality of second heat-transfer plates which are disposed radiately in an annular space defined between a radially outer peripheral wall and a radially inner peripheral wall, whereby a high-temperature fluid passage and a low-temperature fluid passage are defined alternately in a circumferential direction between adjacent ones of the first and second heat-transfer plates, a folding plate blank including the plurality of first heat-transfer plates and the plurality of second heat-transfer plates which are alternately connected together through first and second folding lines, the folding plate blank being folded in a zigzag fashion along the first and second folding lines, and portions corresponding to the first and second folding lines being bonded to the radially outer peripheral wall and the radially inner peripheral wall, respectively, thereby disposing the first and second heat-transfer plates radiately, defining the high-temperature fluid passage and the low-temperature fluid passage alternately in the circumferential direction between the adjacent first and second heat-transfer plates, defining a high-temperature fluid passage inlet and a high-temperature fluid passage outlet so as to open into axially opposite ends of the high-temperature fluid passage, and defining a low-temperature fluid passage inlet and a low-temperature fluid passage outlet so as to open into axially opposite ends of the low-temperature fluid passage, characterized in that the single folding plate blank is folded in the zigzag fashion over 360°, and opposite ends thereof are superposed one on another and bonded together in an area including the first and second folding lines.

With the above arrangement, in forming the annular heat exchanger by folding the folding plate blank including the first and second heat-transfer plates which are alternately connected together through the first and second folding lines in the zigzag fashion, the single folding plate blank is folded in the zigzag fashion over 360°, and the opposite ends thereof are superposed one on another and bonded together in an area including the first or second folding line. Therefore, the heat exchanger can be formed by a minimum number of parts or components, and moreover, the number of bonded zones of the folding plate blank is the minimum, one, thereby suppressing the possibility of leakage of the fluid to the minimum. In addition, the opposite ends of the folding plate blank is merely cut and hence, it is unnecessary to conduct a special processing, leading to a reduced number of processing steps. Moreover, the folded portions of the folding plate blank including the first or second folding line are superposed one on another and hence, the bonding strength is increased. Further, the circumferential pitch of the adjacent first and second heat-transfer plates can be regulated finely only by changing the cutting positions of the folding plate blank to regulate the number of the first and second heat-transfer plates.

BRIEF DESCRIPTION OF THE DRAWINGS

FIGS. 1 to 12 show a first embodiment of the present invention, wherein

FIG. 1 is a side view of the entire arrangement of a gas turbine engine;

FIG. 2 is a sectional view taken along a line 2—2 in FIG. 1;

FIG. 3 is an enlarged sectional view taken along a line 3—3 in FIG. 2 (a sectional view of combustion gas passages);

FIG. 4 is an enlarged sectional view taken along a line 4—4 in FIG. 2 (a sectional view of air passages);

FIG. 5 is an enlarged sectional view taken along a line 5—5 in FIG. 3;

FIG. 6 is an enlarged view of a portion indicated by 6 in FIG. 5;

FIG. 7 is an enlarged sectional view taken along a line 7—7 in FIG. 3;

FIG. 8 is a developed view of a folding plate blank;

FIG. 9 is a perspective view of an essential portion of the heat exchanger;

FIG. 10 is a pattern view showing flows of a combustion gas and air;

FIGS. 13 to 17 show a second embodiment of the present invention, wherein FIG. 13 is a perspective view of the heat exchanger;

FIG. 14 is an enlarged sectional view taken along a line 14—14 in FIG. 13 (a sectional view of combustion gas passages);

FIG. 15 is an enlarged sectional view taken along a line 15—15 in FIG. 13 (a sectional view of air passages);

FIG. 16 is a sectional view taken along a line 16—16 in FIG. 14;

FIG. 17 is an enlarged sectional view taken along a line 17—17 in FIG. 14;

FIGS. 18 to 21 show a modification to the first embodiment, wherein

FIG. 18 is a view similar to FIG. 8 showing the first embodiment, but according to the modification;

FIG. 19 is an enlarged view of an essential portion shown in FIG. 18;

FIG. 20 is a view taken in the direction of an arrow 20 in FIG. 19; and FIG. 21 is a view similar to the FIG. 7 showing the first embodiment, but according to the modification.

BEST MODE FOR CARRYING OUT THE INVENTION

A first embodiment of the present invention will now be described with reference to FIGS. 1 to 12.

Figure 1:
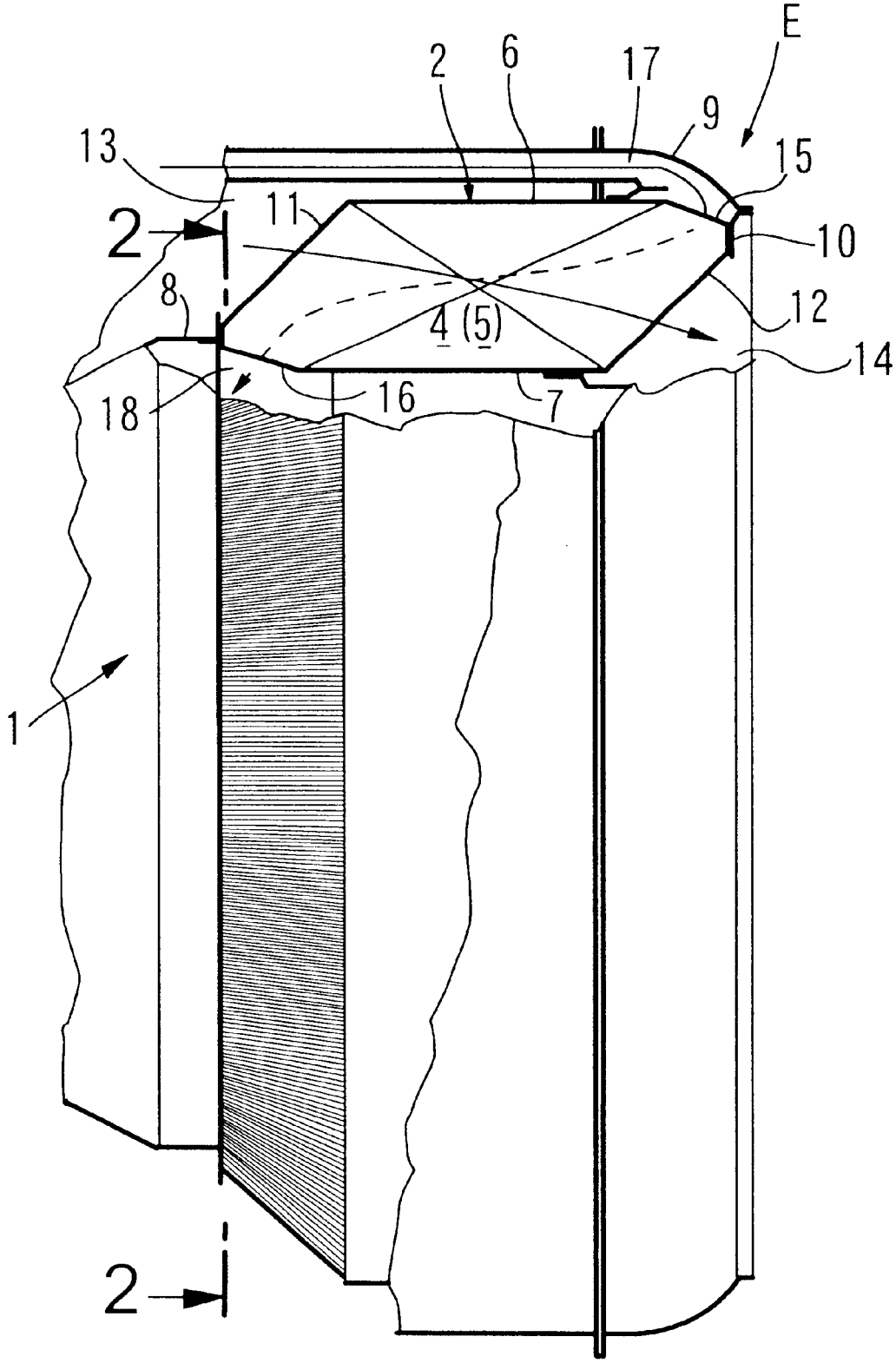
Figure 2:
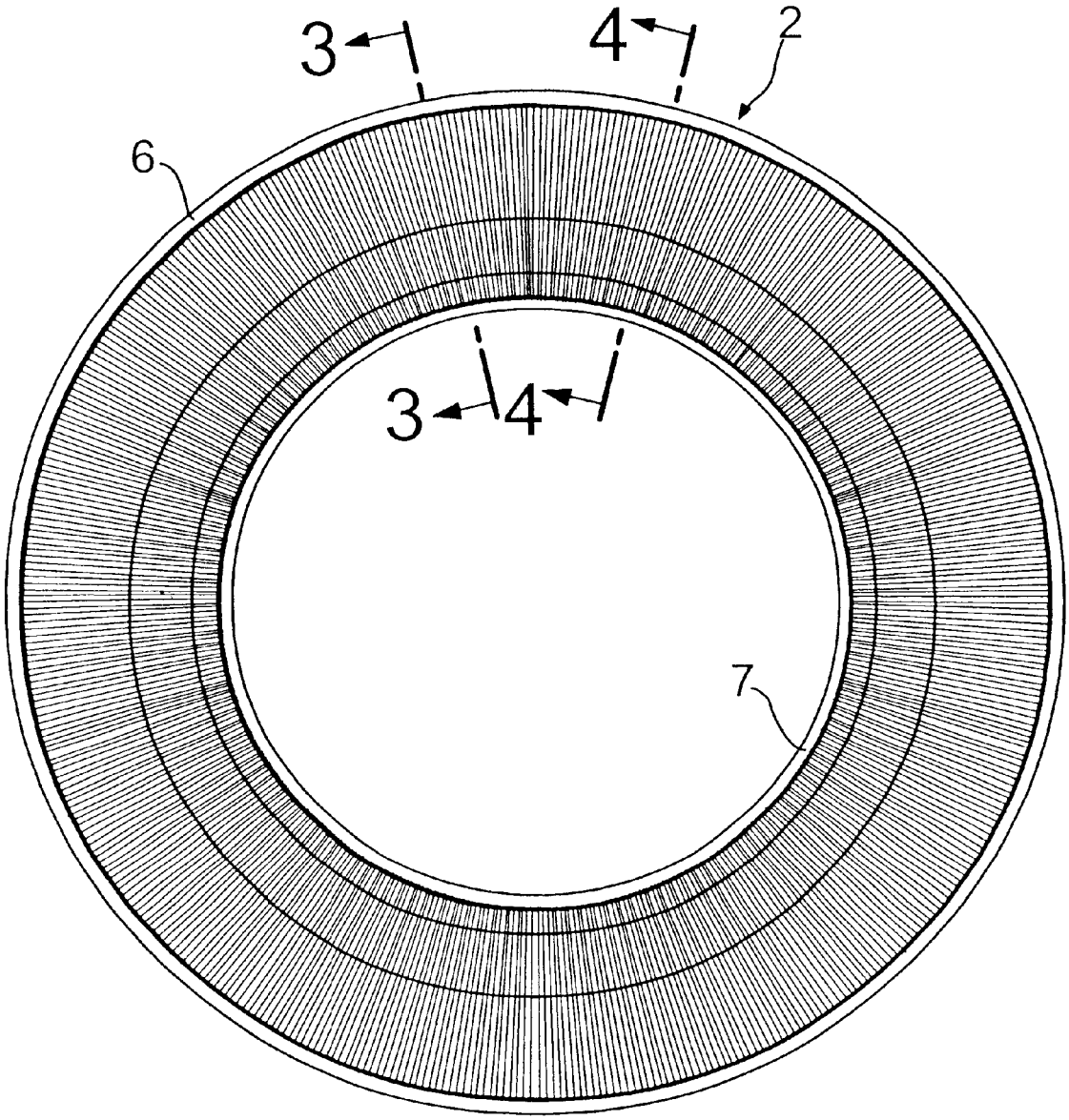

As shown in FIGS. 1 and 2, a gas turbine engine E includes an engine body 1 in which a combustor, a compressor, a turbine and the like (which are not shown) are accommodated. An annular heat exchanger 2 is disposed to surround an outer periphery of the engine body 1. Combustion gas passages 4 and air passages 5 are circumferentially alternately provided in the heat exchanger 2 (see FIG. 5), so that a combustion gas of a relative high temperature passed through turbine is passed through the combustion gas passages 4, and air of a relative low temperature compressed in the compressor is passed through the air passages 5. A section in FIG. 1 corresponds to the combustion gas passages 4, and the air passages 5 are defined adjacent this side and on the other side of the combustion gas passages 4.

The sectional shape of the heat exchanger 2 taken along an axis is axially longer and radially shorter flat hexagonal shape. A radially outer peripheral surface of the heat exchanger 2 is closed by a larger-diameter cylindrical outer casing 6, and a radially inner peripheral surface of the heat exchanger 2 is closed by a smaller-diameter cylindrical inner casing 7. A front end side (a left side in FIG. 1) in the longitudinal section of the heat exchanger 2 is cut into an unequal-length angle shape, and an end plate 8 connected to an outer periphery of the engine body 1 is brazed to a portion corresponding to an apex of the angle shape. A rear end side (a right side in FIG. 1) in the section of the heat exchanger 2 is cut into an unequal-length angle shape, and an end plate 10 connected to an outer housing 9 is brazed to a portion corresponding to an apex of the angle shape.

Each of the combustion gas passages 4 in the heat exchanger 2 includes a combustion gas passage inlet 11 and a combustion gas passage outlet 12 at the left and upper portion and the right and lower portion of FIG. 1, respectively. A combustion gas introducing space (referred to as a combustion gas introducing duct) 13 defined along the outer periphery of the engine body 1 is connected at its downstream end to the combustion gas passage inlet 11. A combustion gas discharging space (referred to as a combustion gas discharging duct) 14 extending within the engine body 1 is connected at its upstream end to the combustion gas passage outlet 12.

Each of the air passages 5 in the heat exchanger 2 includes an air passage inlet 15 and an air passage outlet 16 at the right and upper portion and the left and lower portion of FIG. 1, respectively. An air introducing space (referred to as an air introducing duct) 17 defined along an inner periphery of the outer housing 9 is connected at its downstream end to the air passage inlet 15. An air discharging space (referred to as an air discharging duct) 18 extending within the engine body 1 is connected at its upstream end to the air passage outlet 16.

Figure 3:
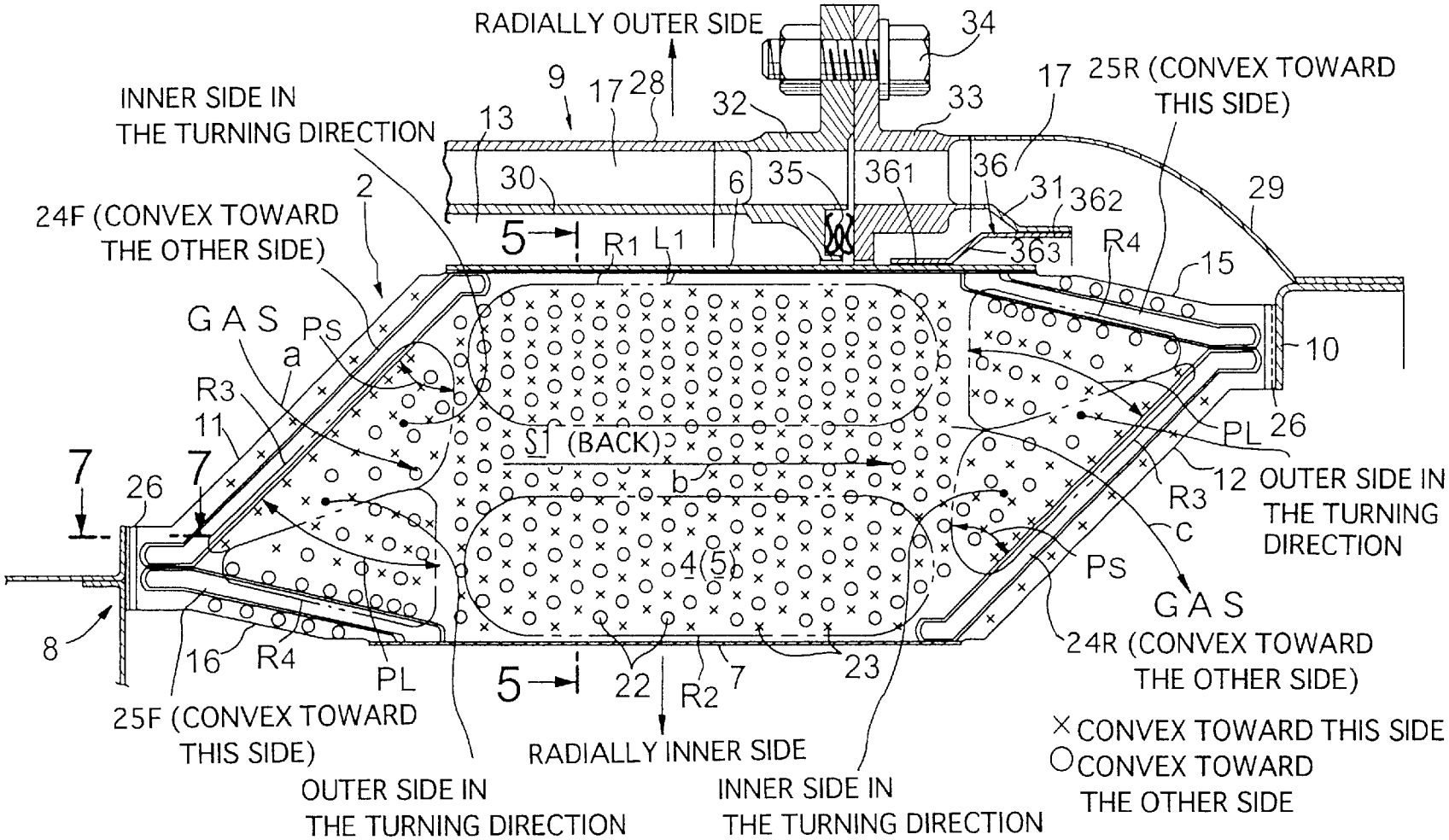
Figure 4:
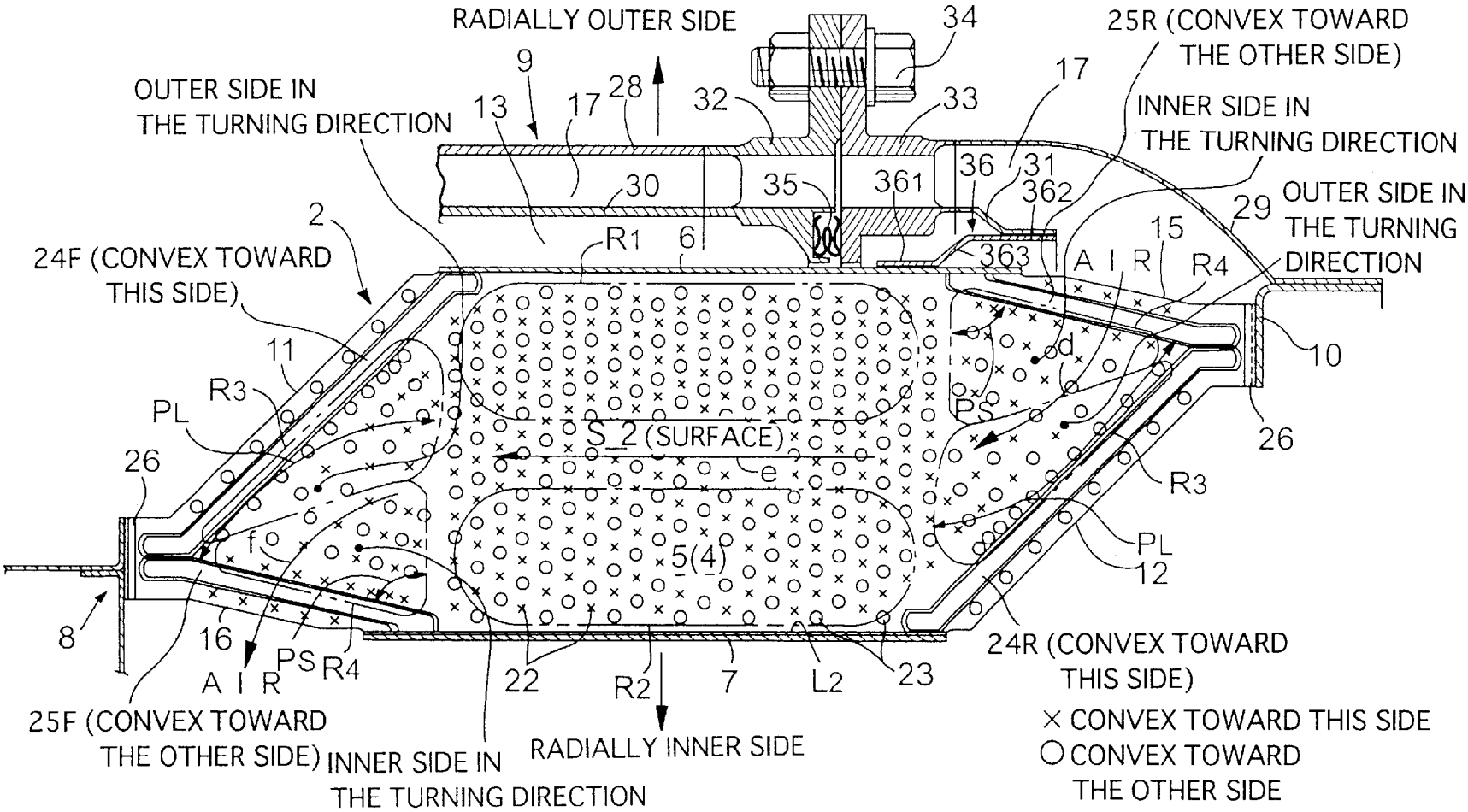
Figure 10:
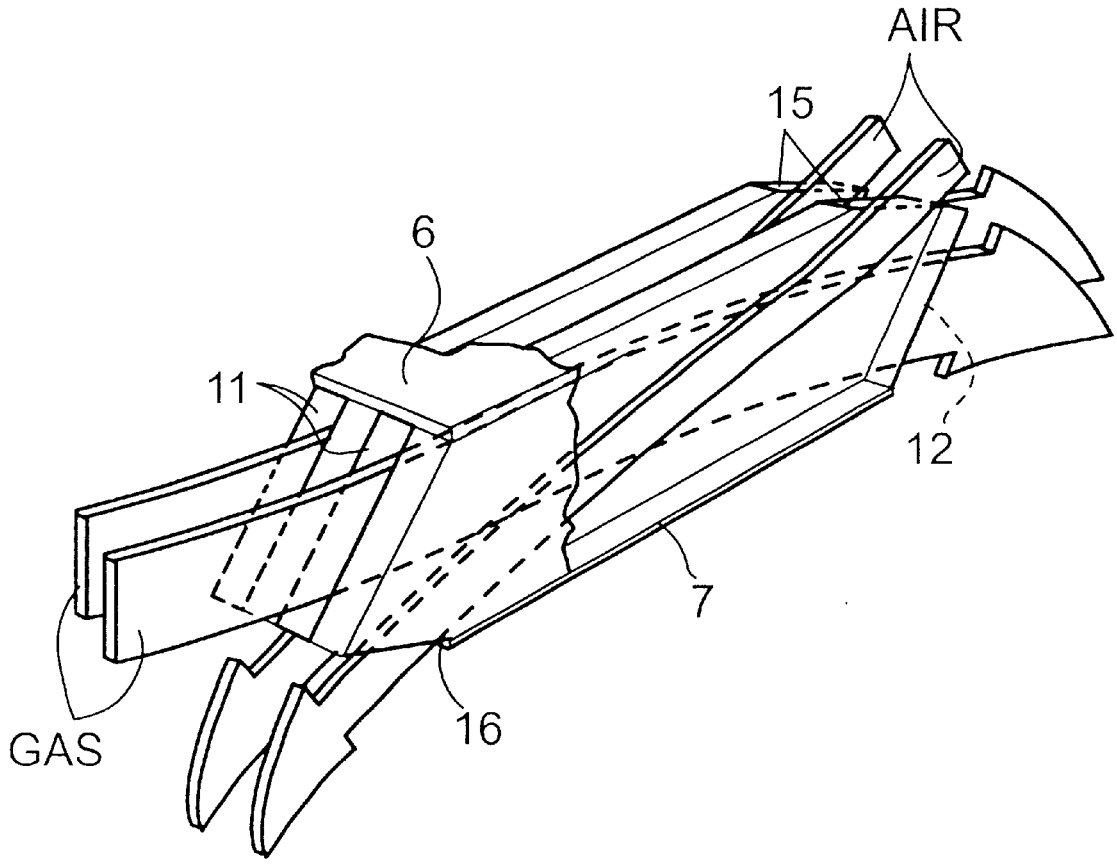

In this manner, the combustion gas and the air flow in opposite directions from each other and cross each other as shown in FIGS. 3, 4 and 10, whereby a counter flow and a so-called cross-flow are realized with a high heat-exchange efficiency. Thus, by allowing a high-temperature fluid and a low-temperature fluid to flow in opposite directions from each other, a large difference in temperature between the high-temperature fluid and the low-temperature fluid can be maintained over the entire length of the flow paths, thereby enhancing the heat-exchange efficiency.

The temperature of the combustion gas which has driven the turbine is about 600 to 700° C. in the combustion gas passage inlets 11. The combustion gas is cooled down to about 300 to 400° C. in the combustion gas passage outlets 12 by conducting a heat-exchange between the combustion gas and the air when the combustion gas passes through the combustion,gas passages 4. On the other hand, the temperature of the air compressed by the compressor is about 200 to 300° C. in the air passage inlets 15. The air is heated up to about 500 to 600° C. in the air passage outlets 16 by conducting a heat-exchange between the air and the combustion gas, which occurs when the air passes through the air passages 5.

The structure of the heat exchanger 2 will be described below with reference to FIGS. 3 to 9.

Figure 8:
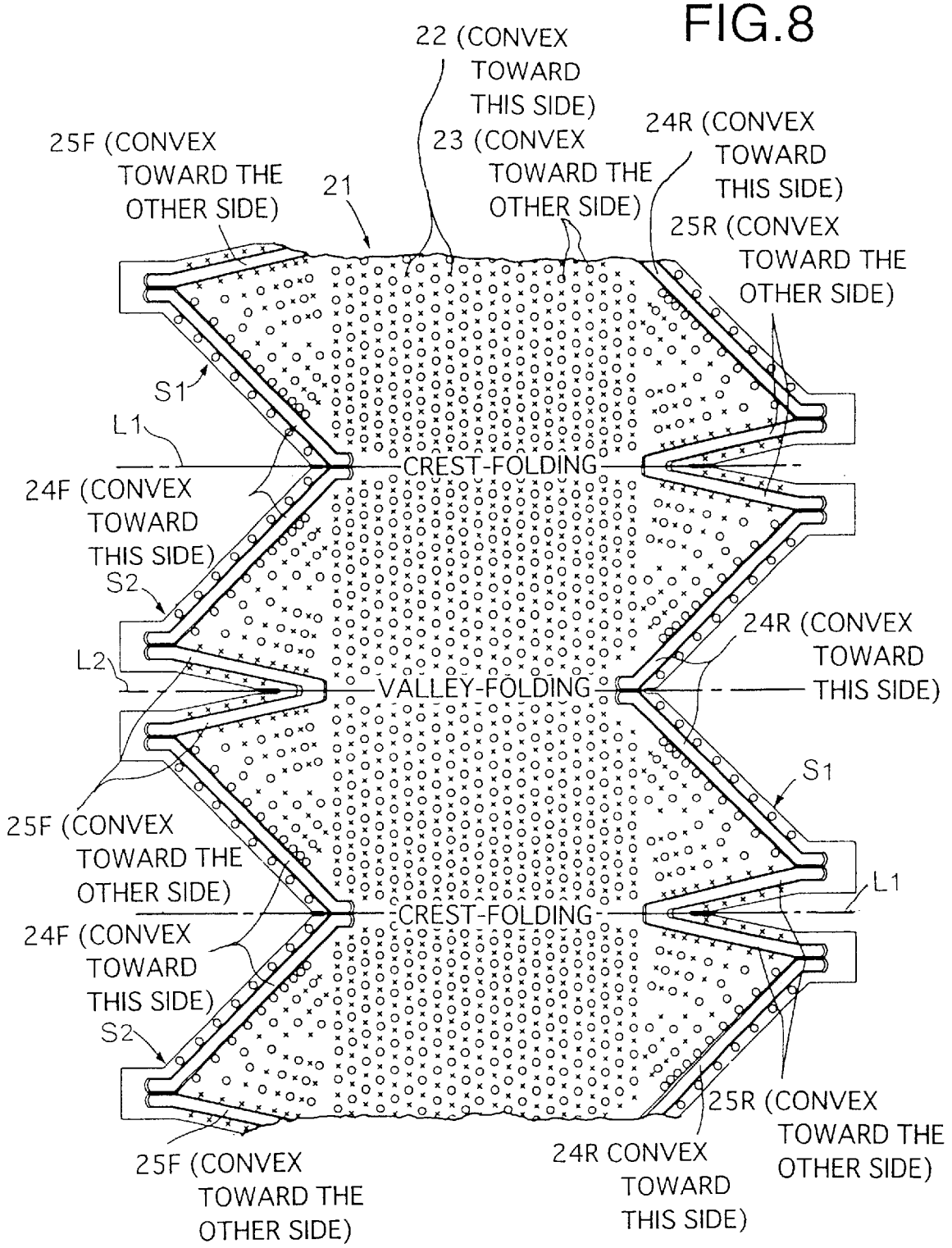

As shown in FIGS. 3, 4 and 8, a body portion of the heat exchanger 2 is made from a folding plate blank 21 produced by previously cutting a thin metal plate such as a stainless steel into a predetermined shape and then forming an irregularity on a surface of the cut plate by pressing. The folding plate blank 21 is comprised of first heat-transfer plates S1 and second heat-transfer plates S2 disposed alternately, and is folded into a zigzag fashion along crest-folding lines $L_1$ and valley-folding lines $L_2$. The term "crest-folding" means folding into a convex toward this side or a closer side from the drawing sheet surface, and the term "valley-folding" means folding into a convex toward the other side or a far side from the drawing sheet surface. Each of the crest-folding lines $L_1$ and the valley-folding lines $L_2$ is not a simple straight line, but actually comprises an arcuate folding line for the purpose of forming a predetermined space between each of the first heat-transfer plates S1 and each of the second heat-transfer plates S2.

A large number of first projections 22 and a large number of second projections 23, which are disposed at unequal distances, are formed on each of the first and second heat-transfer plates S1 and S2 by pressing. The first projections 22 indicated by a mark X in FIG. 8 protrude toward this side on the drawing sheet surface of FIG. 8, and the second projections 23 indicated by a mark O in FIG. 8 protrude toward the other side on the drawing sheet surface of FIG. 8.

First projection stripes $\mathbf{24}_F$ and second projection stripes $\mathbf{25}_F$ are formed by pressing at those front and rear ends of the first and second heat-transfer plates S1 and S2 which are cut into the angle shape. The first projection stripes $\mathbf{24}_F$ protrude toward this side on the drawing sheet surface of FIG. 8, and the second projection stripes $\mathbf{25}_F$ protrude toward the other side on the drawing sheet surface of FIG. 8. In any of the first and second heat-transfer plates S1 and S2, a pair of the front and rear first projection stripes $\mathbf{24}_F$, $\mathbf{24}_R$ are disposed at diagonal positions, and a pair of the front and rear second projection stripes $\mathbf{25}_F$, $\mathbf{25}_R$ are disposed at other diagonal positions.

The first projections 22, the second projections 23, the first projection stripes $\mathbf{24}_F$, $\mathbf{24}_R$ and the second projection stripes $\mathbf{25}_F$, $\mathbf{25}_R$ of the first heat-transfer plate S1 shown in FIG. 3 are in an opposite recess-projection relationship with respect to that in the first heat-transfer plate S1 shown in FIG. 8. This is because FIG. 3 shows a state in which the first heat-transfer plate S1 is viewed from the back side.

Figure 5:
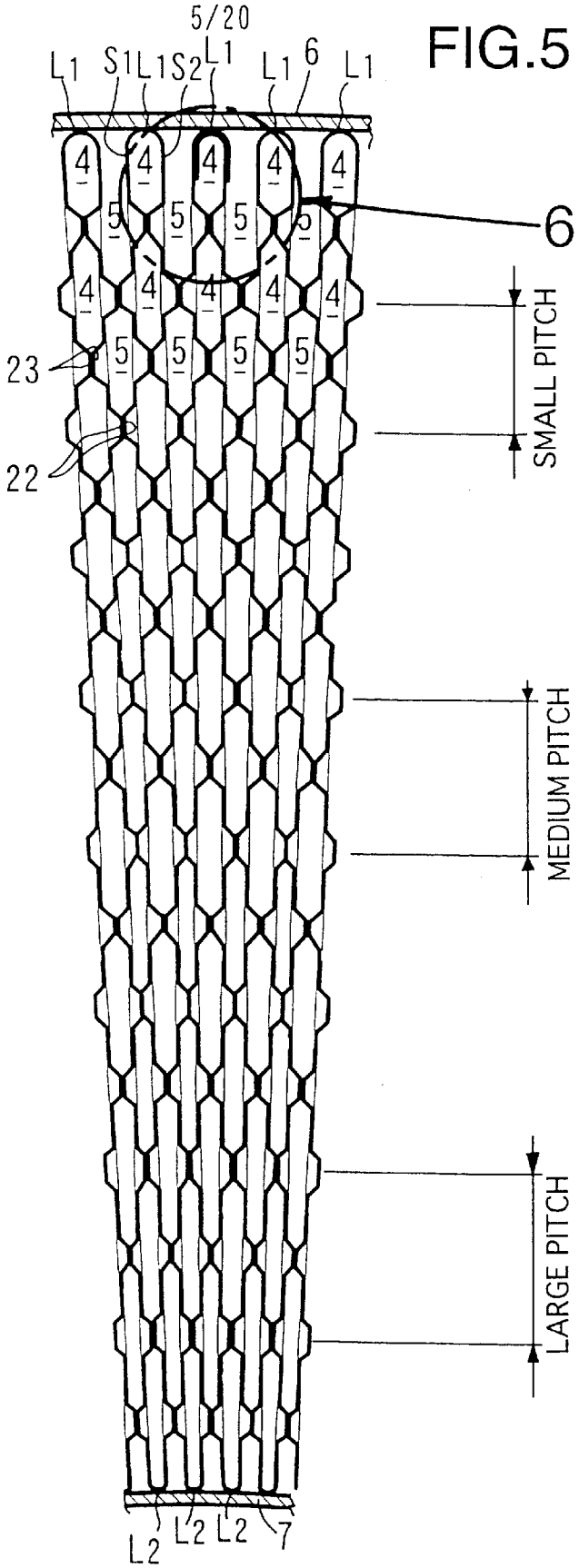

As can be seen from FIGS. 5 and 8, when the first and second heat-transfer plates Si and S2 of the folding plate blank 21 are folded along the crest-folding lines $L_1$ to form the combustion gas passages 4 between both the heat-transfer plates S1 and S2, tip ends of the second projections 23 of the first heat-transfer plate S1 and tip ends of the second projections 23 of the second heat-transfer plate S2 are brought into abutment against each other and brazed to each other. In addition, the second projection stripes $\mathbf{25}_F$, $\mathbf{25}_R$ of the first heat-transfer plate S1 and the second projection stripes $\mathbf{25}_F$, $\mathbf{25}_R$ of the second heat-transfer plate S2 are brought into abutment against each other and brazed to each other. Thus, a left lower portion and a right upper portion of the combustion gas passage 4 shown in FIG. 3 are closed, and each of the first projection stripes $\mathbf{24}_F$, $\mathbf{24}_R$ of the first heat-transfer plate S1 and each of the first projection stripes $\mathbf{24}_F$, $\mathbf{24}_R$ of the second heat-transfer plate S2 are opposed to each other with a gap left therebetween. Further, the combustion gas passage inlet 11 and the combustion gas passage outlet 12 are defined in a left, upper portion and a right, lower portion of the combustion gas passage 4 shown in FIG. 3, respectively.

When the first heat-transfer plates S1 and the second heat-transfer plates S2 of the folding plate blank 21 are folded along the valley-folding line $L_2$ to form the air passages 5 between both the heat-transfer plates S1 and S2, the tip ends of the first projections 22 of the first heat-transfer plate S1 and the tip ends of the first projections 22 of the second heat-transfer plate S2 are brought into abutment against each other and brazed to each other. In addition, the first projection stripes $\mathbf{24}_F$, $\mathbf{24}_R$ of the first heat-transfer plate S1 and the first projection stripes $\mathbf{24}_F$, $\mathbf{24}_R$ of the second heat-transfer plate S2 are brought into abutment against each other and brazed to each other. Thus, a left upper portion and a right lower portion of the air passage 5 shown in FIG. 4 are closed, and each of the second projection stripes $\mathbf{25}_F$, $\mathbf{25}_R$ of the first heat-transfer plate S1 and each of the second projection stripes $\mathbf{25}_F$, $\mathbf{25}_R$ of the second heat-transfer plate S2 are opposed to each other with a gap left therebetween. Further, the air passage inlet 15 and the air passage outlet 16 are defined at a right upper portion and a left lower portion of the air passage 5 shown in FIG. 4, respectively.

Each of the first and second projections 22 and 23 has a substantially truncated conical shape, and the tip ends of the first and second projections 22 and 23 are in surface contact with each other to enhance the brazing strength. Each of the first and second projection stripes $\mathbf{24}_F$, $\mathbf{24}_{R\ and\ 25F}$, $\mathbf{25}_R$ has also a substantially trapezoidal section, and the tip ends of the first and second projection stripes $\mathbf{24}_F$, $\mathbf{24}_R$ and $\mathbf{25}_F$, $\mathbf{25}_R$ are also in surface contact with each other to enhance the brazing strength.

As can be seen from FIG. 5, radially inner peripheral portions of the air passages 5 are automatically closed, because they correspond to the folded portion (the valley-folding line $L_2$) of the folding plate blank 21, but radially outer peripheral portions of the air passages 5 are opened, and such opening portions are closed by brazing to the outer casing 6. On the other hand, radially outer peripheral portions of the combustion gas passages 4 are automatically closed, because they correspond to the folded portion (the crest-folding line $L_1$) of the folding plate blank 21, but radially inner peripheral portions of the combustion gas passages 4 are opened, and such opening portions are closed by brazing to the inner casing 7.

When the folding plate blank 21 is folded in the zigzag fashion, the adjacent crest-folding lines $L_1$ cannot be brought into direct contact with each other, but the distance between the crest-folding lines $L_1$ is maintained constant by the contact of the first projections 22 to each other. In addition, the adjacent valley-folding lines $L_2$ cannot be brought into direct contact with each other, but the distance between the valley-folding lines $L_2$ is maintained constant by the contact of the second projections 23 to each other.

When the folding plate blank 21 is folded in the zigzag fashion to produce the body portion of the heat exchanger 2, the first and second heat-transfer plates S1 and S2 are disposed radiately from the center of the heat exchanger 2. Therefore, the distance between the adjacent first and second heat-transfer plates S1 and S2 assumes the maximum in the radially outer peripheral portion which is in contact with the outer casing 6, and the minimum in the radially inner peripheral portion which is in contact with the inner casing 7. For this reason, the heights of the first projections 22, the second projections 23, the first projection stripes $\mathbf{24}_F$, $\mathbf{24}_R$ and the second projection stripes $\mathbf{25}_F$, $\mathbf{25}_R$ are gradually increased outwards from the radially inner side, whereby the first and second heat-transfer plates S1 and S2 can be disposed exactly radiately (see FIG. 5).

By employing the above-described structure of the radiately folded plates, the outer casing 6 and the inner casing 7 can be positioned concentrically, and the axial symmetry of the heat exchanger 2 can be maintained accurately.

Figure 7:
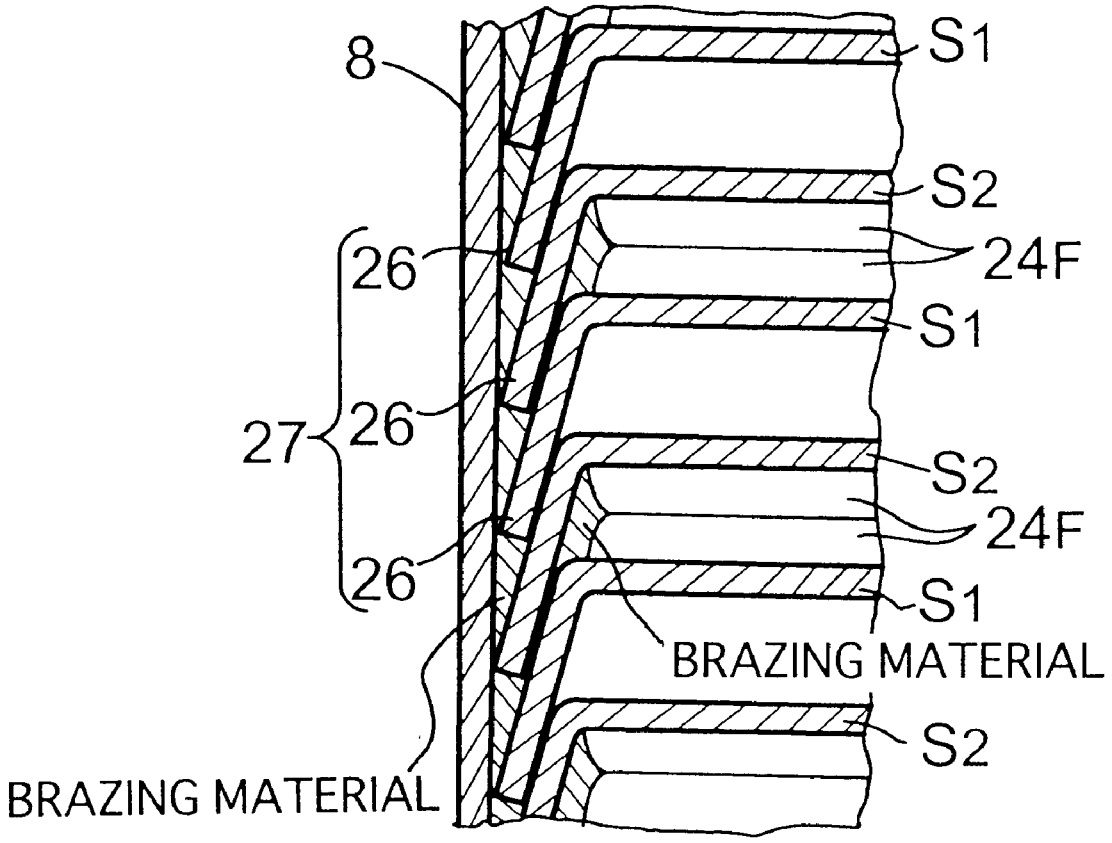
Figure 9:
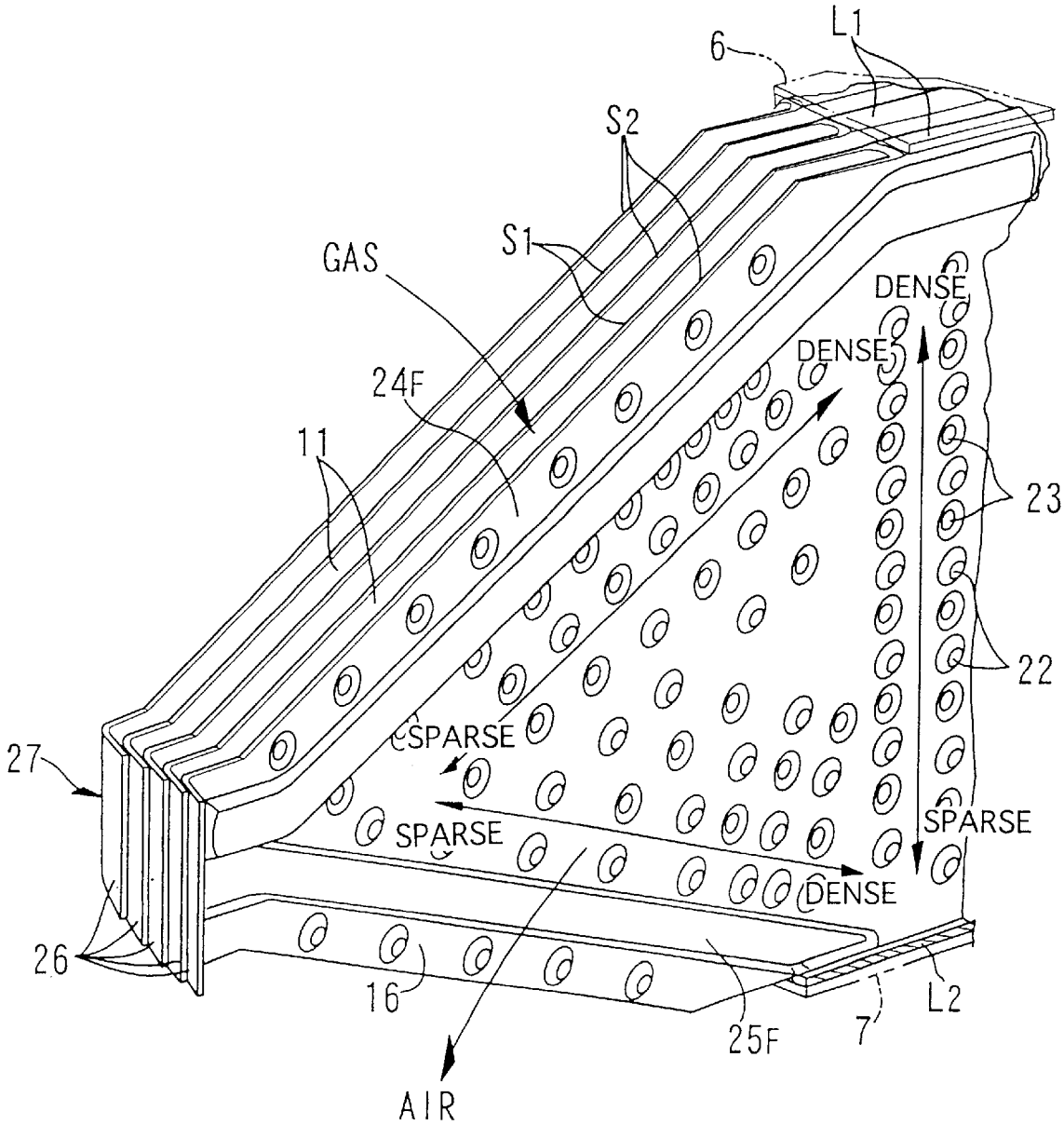

As can be seen from FIGS. 7 and 9, rectangular small piece-shaped flange portions 26 are formed by folding, apexes of front and rear ends of the first and second heat-transfer plates S1 and S2 cut into the angle shape, at an angle slightly smaller than 90° in the circumferential direction of the heat exchanger 2. When the folding plate blank 21 is folded in the zigzag fashion, a portion of each of the flanges 26 of the first and second heat-transfer plates S1 and S2 is superposed on and brazed in a surface contact state to a portion of the adjacent flange portion 26, thereby forming an annular bonding flange 27 as a whole. The bonding flange 27 is bonded by brazing to the front and rear end plates 8 and 10.

At this time, the front surface of the bonding flange 27 is of a stepped configuration, and a slight gap is defined between the bonding flange 27 and each of the end plates 8 and 10, but the gap is closed by a brazing material (see FIG. 7). The flange portions 26 are folded in the vicinity of the tip ends of the first projection stripes $\mathbf{24}_F$ and $\mathbf{24}_R$ and the second projection stripes $\mathbf{25}_F$ and $\mathbf{25}_R$ formed on the first and second heat-transfer plates S1 and S2. When the folding plate blank 21 has been folded along the crest-folding line $L_1$ and the valley-folding line $L_2$, slight gaps are also defined between the tip ends of the first projection stripes $\mathbf{24}_F$ and $\mathbf{24}_R$ and the second projection stripes $\mathbf{25}_F$ and $\mathbf{25}_R$ and the flange portions 26, but the gaps are closed by the brazing material (see FIG. 7).

If an attempt is made to cut the apex portions of angle shapes of the first and second heat-transfer plates S1 and S2 into flat, and braze the end plates 8 and 10 to end surfaces resulting from such cutting, it is necessary to first fold the folding plate blank 21 and braze the first projections 22 and the second projections 23 as well as the first projection stripes $\mathbf{24}_F$ and $\mathbf{24}_R$ and the second projection stripes $\mathbf{25}_F$ and $\mathbf{25}_R$ of the first and second heat-transfer plates S1 and S2 to each other, and then subject the apex portions to a precise cutting treatment for brazing to the end plates 8 and 10. In this case, the two brazing steps are required, resulting in not only an increased number of steps but also an increased cost because of a high processing precision required for the cut surfaces. Moreover, it is difficult to provide a strength sufficient for brazing of the cut surfaces having a small area. However, by brazing the flange portions 26 formed by the folding, the brazing of the first projections 22 and the second projections 23 as well as the first projection stripes $\mathbf{24}_F$ and $\mathbf{24}_R$ and the second projection stripes $\mathbf{25}_F$ and $\mathbf{25}_R$ and the brazing of the flange portions 26 can be accomplished in a continuous flow, and further, the precise cutting treatment of the apex portions of the angle shapes is not required. Moreover, the flange portions 26 in surface contact with one another are brazed together, leading to remarkably increased brazing strength. Further, the flange portions themselves form the bonding flange 27, which can contribute to a reduction in number of parts.

By folding the folding plate blank 21 radiately and in the zigzag fashion to form the first and second heat-transfer plates S1 and S2 continuously, the number of parts and the number of points to be brazed can be reduced remarkably, and moreover, the dimensional precision of the completed article can be enhanced, as compared with the case where a large number of first heat-transfer plates S1 individually independent from one another and a large number of second heat-transfer plates S2 individually independent from one another are brazed alternately.

Figure 6:
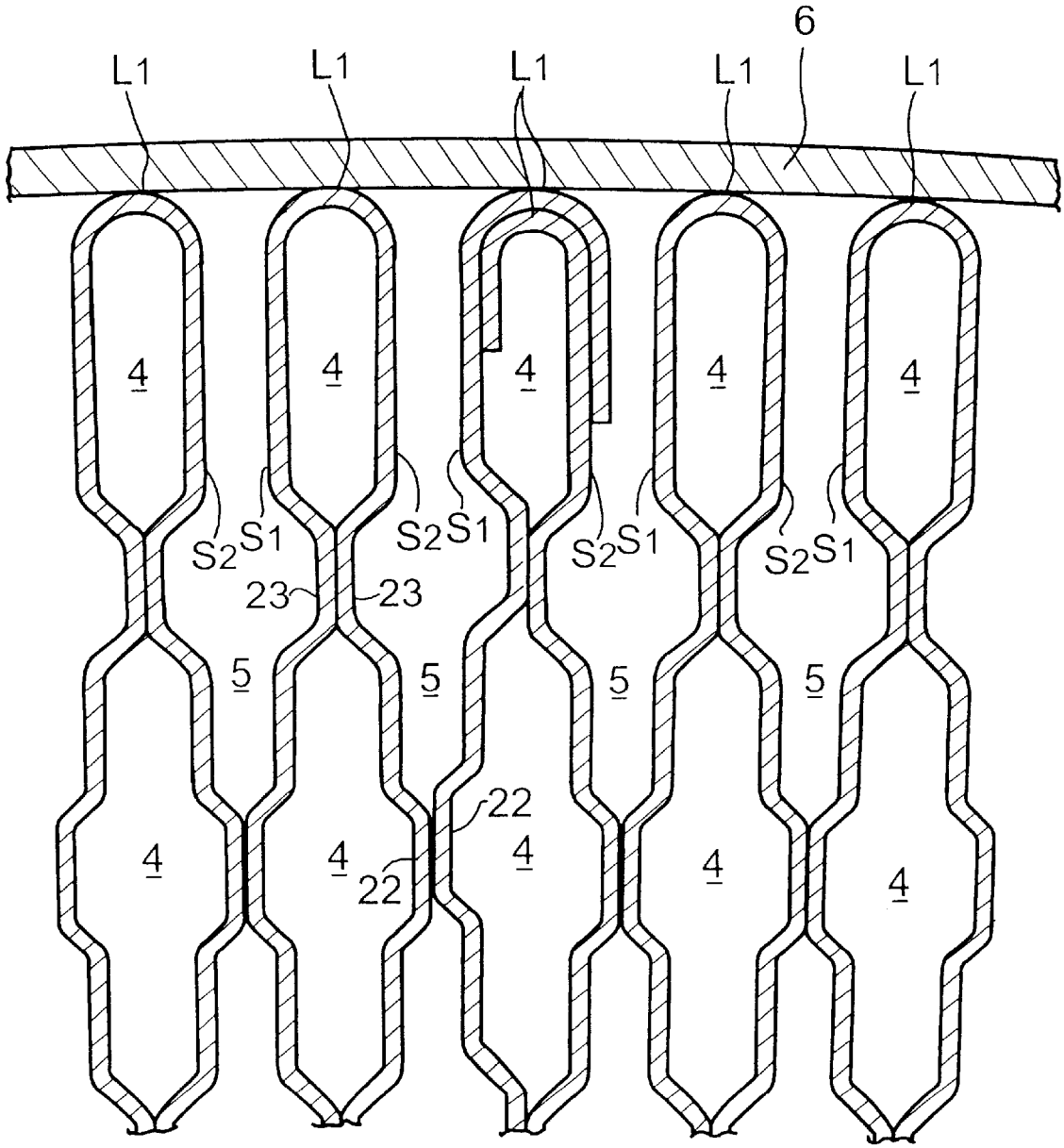

As can be seen from FIGS. 5 and 6, when the single folding plate blank 21 formed into a band shape is folded in a zigzag fashion to form the body portion of the heat exchanger 2, opposite ends of the folding plate blank 21 are integrally bonded to each other at a radially outer peripheral portion of the heat exchanger 2. Therefore, end edges of the first and second heat-transfer plates S1 and S2 adjoining each other with the bonded portion interposed therebetween are cut into a J-shape in the vicinity of the crest-folding line $L_1$, and for example, an outer periphery of the J-shaped cut portion of the second heat-transfer plate S2 is fitted to and brazed to an inner periphery of the J-shaped cut portion of the first heat-transfer plate S1. Since the J-shaped cut portions of the first and second heat-transfer plates S1 and S2 are fitted to each other, the J-shaped cut portion of the outer first heat-transfer plate S1 is forced to be expanded, while the J-shaped cut portion of the inner second heat-transfer plate S2 is forced to be contracted. Further, the inner second heat-transfer plate S2 is compressed inwards radially of the heat exchanger 2.

By employing the above-described structure, a special bonding member for bonding the opposite ends of the folding plate blank 21 to each other is not required, and a special processing such as changing the shape of the folding plate blank 21 is not required, either. Therefore, the number of parts and the processing cost are reduced, and an increase in heat mass in the bonded zone is avoided. Moreover, a dead space which is not the combustion gas passages 4 nor the air passages 5 is not created and hence, the increase in flow path resistance is maintained to the minimum, and there is not a possibility that the heat exchange efficiency may be reduced. Further, the bonded zone of the J-shaped cut portions of the first and second heat-transfer plates S1 and S2 is deformed and hence, a very small gap is liable to be produced. However, only the bonded zone may be the minimum, one by forming the body portion of the heat exchanger 2 by the single folding plate blank 21, and the leakage of the fluid can be suppressed to the minimum. Additionally, when the single folding plate blank 21 is folded in the zigzag fashion to form the body portion of the annular heat exchanger 2, if the numbers of the first and second heat-transfer plates S1 and S2 integrally connected to each other are not suitable, the circumferential pitch between the adjacent first and second heat-transfer plates S1 and S2 is inappropriate and moreover, there is a possibility that the tip ends of the first and second projection 22 and 23 may be separated or crushed. However, the circumferential pitch can be finely regulated easily only by changing the cutting position of the folding plate blank 21 to properly change the numbers of the first and second heat-transfer plates S1 and S2 integrally connected to each other.

During operation of the gas turbine engine E, the pressure in the combustion gas passages 4 is relatively low, and the pressure in the air passages 5 is relatively high. For this reason, a flexural load is applied to the first and second heat-transfer plates S1 and S2 due to a difference between the pressures, but a sufficient rigidity capable of withstanding such load can be obtained by virtue of the first and second projections 22 and 23 which have been brought into abutment against each other and brazed with each other.

In addition, the surface areas of the first and second heat-transfer plates S1 and S2 (i.e., the surface areas of the combustion gas passages 4 and the air passages 5) are increased by virtue of the first and second projections 22 and 23. Moreover, the flows of the combustion gas and the air are agitated and hence, the heat exchange efficiency can be enhanced.

The unit amount $N_{tu}$ of heat transfer representing the amount of heat transferred between the combustion gas passages 4 and the air passages 5 is given by the following equation (1):

$$N_{tu}=(K\times A)/[C\times(dm/dt)] \quad (1)$$

In the above equation (1), K is an overall heat transfer coefficient of the first and second heat-transfer plates S1 and S2; A is an area (a heat-transfer area) of the first and second heat-transfer plates S1 and S2; C is a specific heat of a fluid; and dm/dt is a mass flow rate of the fluid flowing in the heat transfer area. Each of the heat transfer area A and the specific heat C is a constant, but each of the overall heat transfer coefficient K and the mass flow rate dm/dt is a function of a pitch P (see FIG. 5) between the adjacent first projections 22 or between the adjacent second projections 23.

When the unit amount $N_{tu}$ of heat transfer is varied in the radial directions of the first and second heat-transfer plates S1 and S2, the distribution of temperature of the first and second heat-transfer plates S1 and S2 is non-uniformed radially, resulting in a reduced heat exchange efficiency, and moreover, the first and second heat-transfer plates S1 and S2 are non-uniformly, thermally expanded radially to generate undesirable thermal stress. Therefore, if the pitch P of radial arrangement of the first and second projections 22 and 23 is set suitably, so that the unit amount $N_{tu}$ of heat transfer is constant in radially various sites of the first and second heat-transfer plates S1 and S2, the above problems can be overcome.

Figure 11A:
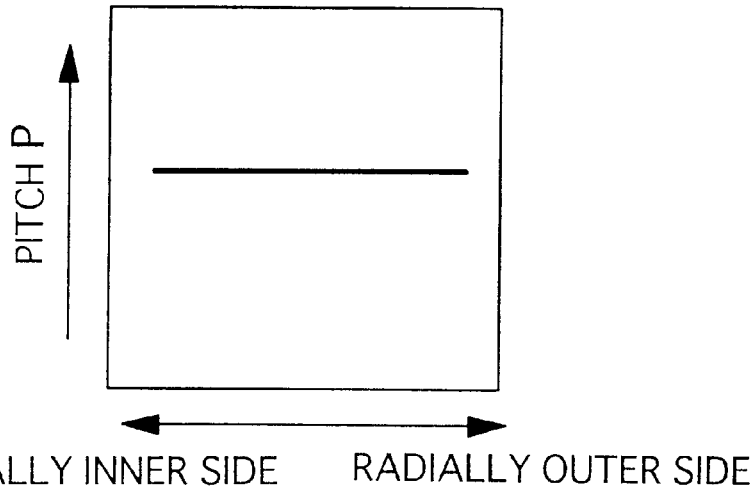
FIGS. 11A to 11C are graphs for explaining the operation when the pitch between projections is uniform.
Figure 11B:
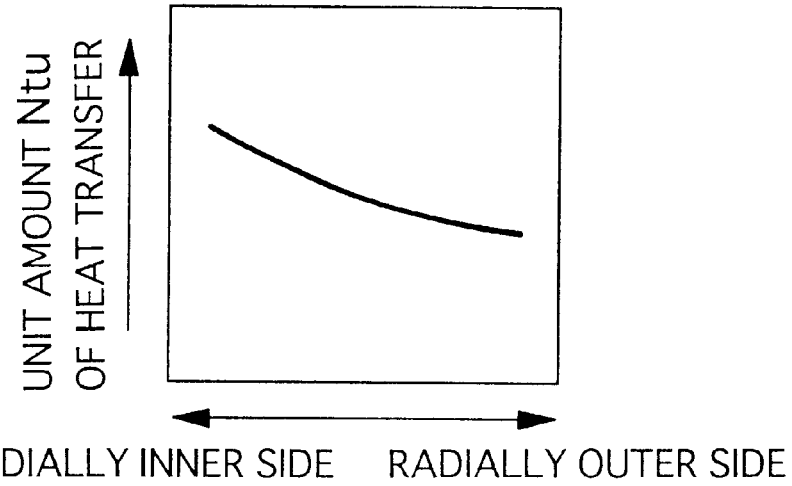
Figure 11C:
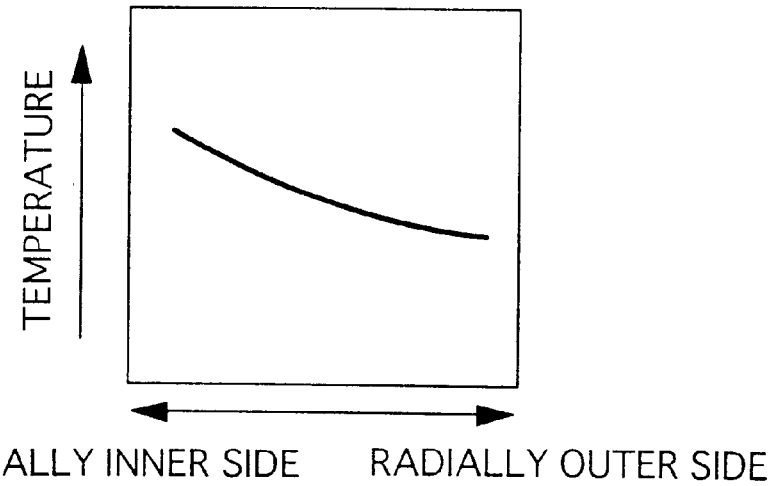
Figure 12A:
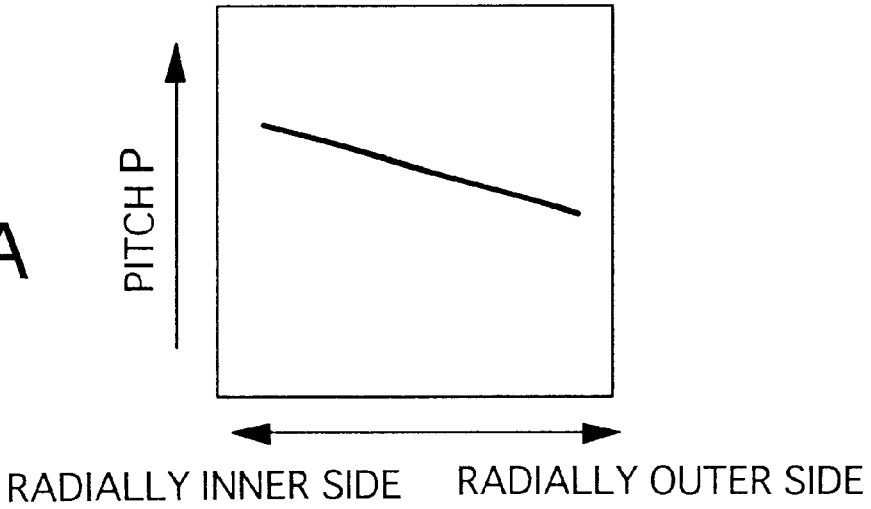
FIGS. 12A to 12C are graphs for explaining the operation when the pitch between projections is non-uniform.
Figure 12B:
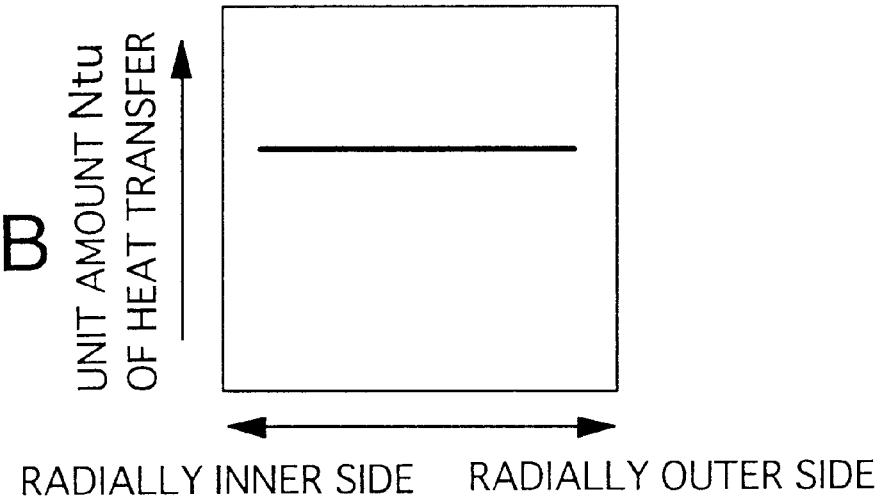
Figure 12C:
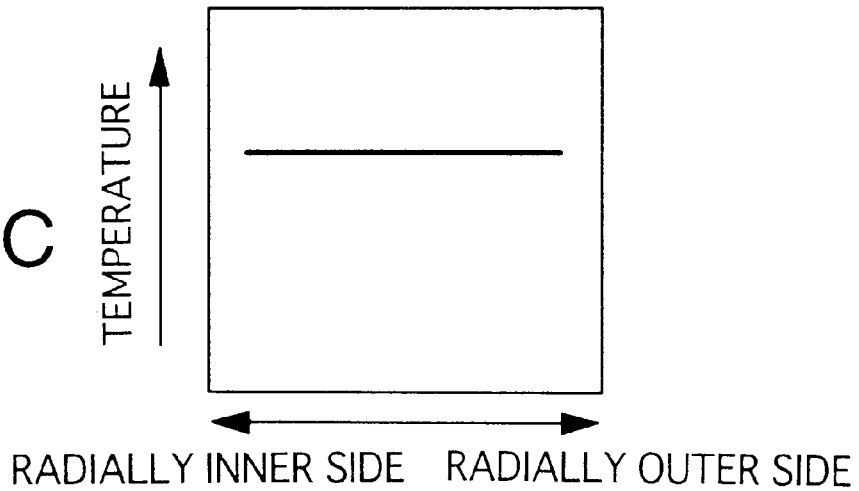
Figure 13:
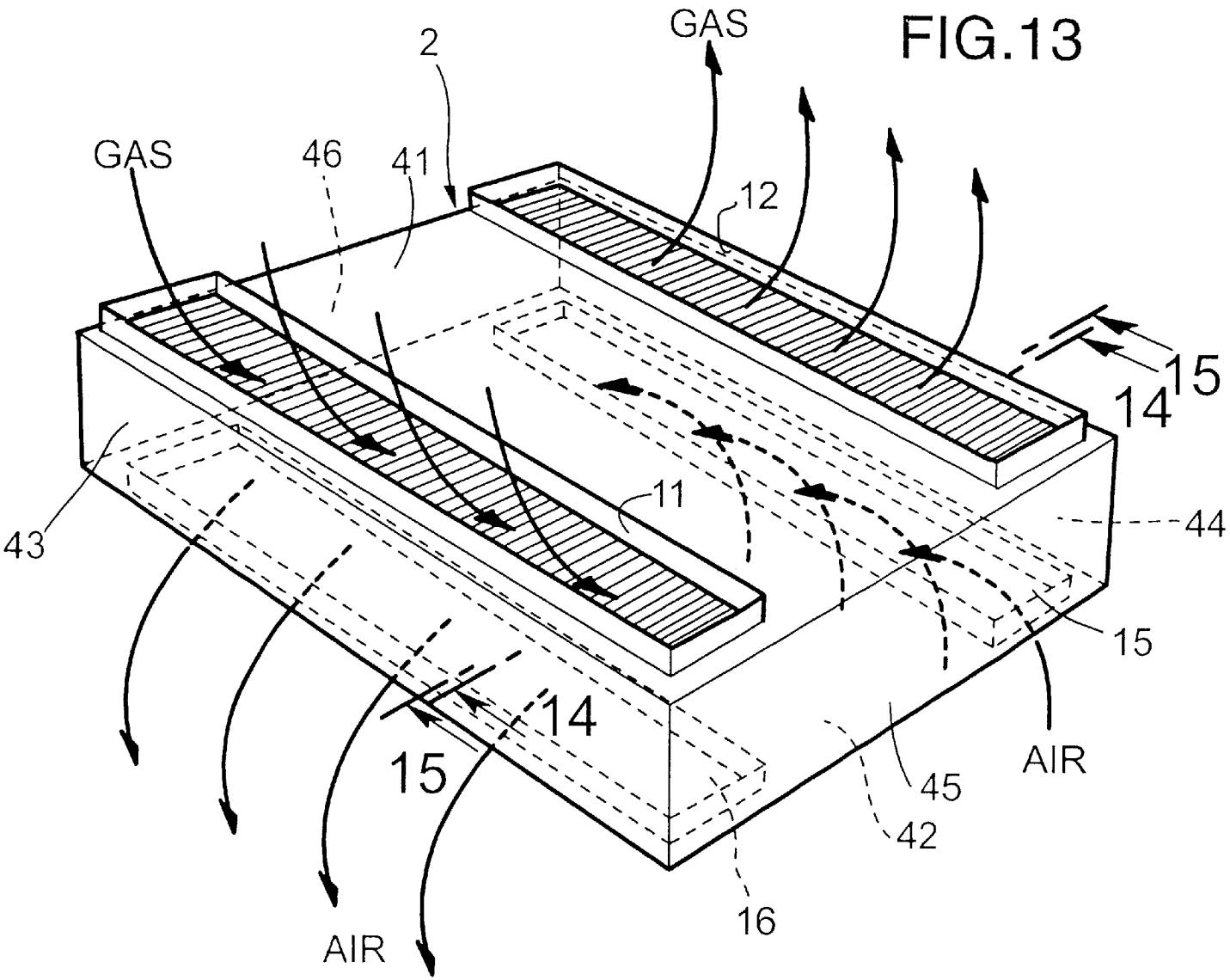

When the pitch P is set constant in the radial directions of the heat exchanger 2, as shown in FIG. 11A, the unit amount $N_{tu}$ of heat transfer is larger at the radially inner portion and smaller at the radially outer portion, as shown in FIG. 11B. Therefore, the distribution of temperature of the first and second heat-transfer plates S1 and S2 is also higher at the radially inner portion and lower at the radially outer portion, as shown in FIG. 11C. On the other hand, if the pitch P is set so that it is larger in the radially inner portion of the heat exchanger 2 and smaller in the radially outer portion of the heat exchanger 2, as shown in FIG. 12A, the unit amount $N_{tu}$ of heat transfer and the distribution of temperature can be made substantially constant in the radial directions, as shown in FIGS. 12B and 12C.

As can be seen from FIGS. 3 to 5, in the heat exchanger 2 according to this embodiment, a region $R_1$ having a small pitch P of radial arrangement of the first and second projections 22 and 23 is provided in the radially outer portions of the axially intermediate portions of the first and second heat-transfer plates S1 and S2 (namely, portions other than the angle-shaped portions at the axially opposite ends), and a region $R_2$ having a large pitch P of radial arrangement of the first and second projections 22 and 23 is provided in the radially inner portion. Thus, the unit number $N_{tu}$ of heat transfer can be made substantially constant over the entire region of the axially intermediate portions of the first and second heat-transfer plates S1 and S2, and it is possible to enhance the heat exchange efficiency and to alleviate the thermal stress.

If the entire shape of the heat exchanger and the shapes of the first and second projections 22 and 23 are varied, the overall heat transfer coefficient K and the mass flow rate dm/dt are also varied and hence, the suitable arrangement of pitches P is also different from that in the present embodiment. Therefore, in addition to a case where the pitch P is gradually decreased radially outwards as in the present embodiment, the pitch P may be gradually increased radially outwards in some cases. However, if the arrangement of pitches P is determined such that the above-described equation (1) is established, the operational effect can be obtained irrespective of the entire shape of the heat exchanger and the shapes of the first and second projections 22 and 23.

As can be seen from FIGS .3 and 4, in the axially intermediate portions of the first and second heat-transfer plates S1 and S2, the adjacent first projections 22 or the adjacent second projections 23 are not arranged in a row in the axial direction of the heat exchanger 2 (in the direction of flowing of the combustion gas and the air), but are arranged so as to be inclined at a predetermined angle with respect to the axial direction. In other words, a consideration is taken so that the first projections 22 as well as the second projections 23 cannot be arranged continuously on a straight line parallel to the axis of the heat exchanger 2. Thus, the combustion gas passages 4 and the air passages 5 can be defined in a labyrinth-shaped configuration by the first and second projections 22 and 23 in the axially intermediate portions of the first and second heat-transfer plates S1 and S2, thereby enhancing the heat exchange efficiency.

Further, the first and second projections 22 and 23 are arranged in the angle-shaped portions at the axially opposite ends of the first and second heat-transfer plates S1 and S2 at an arrangement pitch different from that in the axially intermediate portion. In the combustion gas passage 4 shown in FIG. 3, the combustion gas flowing thereinto through the combustion gas passage inlet 11 in the direction of an arrow a is turned in the axial direction to flow in the direction of an arrow b, and is further turned in the direction of an arrow c to flow out through the combustion gas passage outlet 12. When the combustion gas changes its course in the vicinity of the combustion gas passage inlet 11, a combustion gas flow path $P_s$ is shortened on the inner side as viewed in the turning direction (on the radially outer side of the heat exchanger 2), and a combustion gas flow path $P_L$ is prolonged on the outer side as viewed in the turning direction (on the radially inner side of the heat exchanger 2). On the other hand, when the combustion gas changes its course in the vicinity of the combustion gas passage outlet 12, the combustion gas flow path $P_S$ is shortened on the inner side as viewed in the turning direction (on the radially inner side of the heat exchanger 2), and the combustion gas flow path $P_L$ is prolonged on the outer side as viewed in the turning direction (on the radially outer side of the heat exchanger 2). When a difference is produced between the lengths of the combustion gas flow paths on the inner and outer sides as viewed in the direction of turning of the combustion gas, the combustion gas flows in a drifting manner from the outer side as viewed in the turning direction toward the inner side where the flow resistance is small because of the short flow path, whereby the flow of the combustion gas is non-uniformized, resulting in a reduction in heat exchange efficiency.

Therefore, in regions $R_3$, $R_3$ in the vicinity of the combustion gas passage inlet 11 and the combustion gas passage outlet 12, the pitch of arrangement of the first projections 22 as well as the second projections 23 in the direction perpendicular to the direction of flowing of the combustion gas is varied so that it becomes gradually denser from the outer side toward the inner side as viewed in the turning direction. By non-uniformizing the pitch of arrangement of the first projections 22 as well as the second projections 23 in the regions $R_3$, $R_3$ in the above manner, the first and second projections 22 and 23 can be arranged densely on the inner side as viewed in the turning direction where the flow path resistance is small because of the short flow path of the combustion gas, whereby the flow path resistance can be increased, thereby uniformizing the flow path resistance over the entire regions $R_3$, $R_3$. Thus, the generation of the drifting flow can be prevented to avoid the reduction in heat exchange efficiency. Particularly, all the projections in a first row adjacent the inner side of the first projection stripes $\mathbf{24}_F$, $\mathbf{24}_R$ comprise the second projections 23 protruding into the combustion gas passages 4 (indicated by a mark x in FIG. 3). Therefore, a drifting flow preventing effect can effectively be exhibited by non-uniformizing the pitch of arrangement of the second projections 23.

Likewise, in the air passage 5 shown in FIG. 4, the air flowing thereinto in the direction of an arrow d through the air passage inlet 15 is turned axially to flow in the direction of an arrow e, and further turned in the direction of an arrow f to flow out through the air passage outlet 16. When the air changes its course in the vicinity of the air passage inlet 15, the air flow path is shortened on the inner side as viewed in the turning direction (on the radially outer side of the heat exchanger 2), and the air flow path is prolonged on the outer side as viewed in the turning direction (on the radially inner side of the heat exchanger 2). On the other hand, when the air changes its course in the vicinity of the air passage outlet 16, the air flow path is shortened on the inner side as viewed in the turning direction (on the radially inner side of the heat exchanger 2), and the air flow path is prolonged on the outer side as viewed in the turning direction (on the radially outer side of the heat exchanger 2). When a difference is generated between the lengths of the air flow paths on the inner and outer sides as viewed in the direction of turning of the air, the air flows in a drifting manner toward the inner side as viewed in the turning direction where the flow path resistance is smaller because of the short flow path, thereby reducing the heat exchange efficiency.

Therefore, in regions $R_4$, $R_4$ in the vicinity of the air passage inlet 15 and the air passage outlet 16, the pitch of arrangement of the first projections 22 as well as the second projections 23 in the direction perpendicular to the direction of flowing of the air is varied so that it becomes gradually denser from the outer side toward the inner side as viewed in the turning direction. By non-uniformizing the pitch of arrangement of the first projections 22 as well as the second projections 23 in the regions $R_4$, $R_4$ in the above manner, the first and second projections 22 and 23 can be arranged densely on the inner side as viewed in the turning direction where the flow path resistance is small because of the short flow path of the air, whereby the flow path resistance can be increased, thereby uniformizing the flow path resistance over the entire regions $R_4$, $R_4$. Thus, the generation of the drifting flow can be prevented to avoid the reduction in heat exchange efficiency. Particularly, all the projections in a first row adjacent the inner side of the second projection stripes $\mathbf{25}_F$, $\mathbf{25}_R$ comprise the first projections 22 protruding into the combustion gas passages 4 (indicated by a mark x in FIG. 4). Therefore, a drifting flow preventing effect can effectively be exhibited by non-uniformizing the pitch of arrangement of the first projections 22.

When the combustion gas flows in each of the regions $R_4$, $R_4$ adjacent the regions $R_3$, $R_3$ in FIG. 3, the pitch of arrangement of the first projections 22 as well as the second projections 23 in the region $R_4$, $R_4$ little exerts an influence to the flowing of the combustion gas, because the pitch is non-uniform in the direction of flowing of the combustion gas. Likewise, when the air flows in each of the regions $R_3$, $R_3$ adjacent the regions $R_4$, $R_4$ in FIG. 4, the pitch of arrangement of the first projections 22 as well as the second projections 23 in the region $R_3$, $R_3$ little exerts an influence to the flowing of the combustion gas, because the pitch is non-uniform in the direction of flowing of the air.

As can be seen from FIGS. 3 and 4, the first and second heat-transfer plates S1 and S2 are cut into an unequal-length angle shape having a long side and a short side at the front and rear ends of the heat exchanger 2. The combustion gas passage inlet 11 and the combustion gas passage outlet 12 are defined along the long sides at the front and rear ends, respectively, and the air passage inlet 15 and the air passage outlet 16 are defined along the short sides at the rear and front ends, respectively.

In this way, the combustion gas passage inlet 11 and the air passage outlet 16 are defined respectively along the two sides of the angle shape at the front end of the heat exchanger 2, and the combustion gas passage outlet 12 and the air passage inlet 15 are defined respectively along the two sides of the angle shape at the rear end of the heat exchanger 2. Therefore, larger sectional areas of the flow paths in the inlets 11, 15 and the outlets 12, 16 can be ensured to suppress the pressure loss to the minimum, as compared with a case where the inlets 11, 15 and the outlets 12, 16 are defined without cutting of the front and rear ends of the heat exchanger 2 into the angle shape. Moreover, since the inlets 11, 15 and the outlets 12, 16 are defined along the two sides of the angle shape, not only the flow paths for the combustion gas and the air flowing out of and into the combustion gas passages 4 and the air passages 5 can be smoothened to further reduce the pressure loss, but also the ducts connected to the inlets 11, 15 and the outlets 12, 16 can be disposed in the axial direction without sharp bending of the flow paths, whereby the radial dimension of the heat exchanger 2 can be reduced.

As compared with the volume flow rate of the air passed through the air passage inlet 15 and the air passage outlet 16, the volume flow rate of the combustion gas, which has been produced by burning a fuel-air mixture resulting from mixing of fuel into the air and expanded in the turbine into a dropped pressure, is larger. In the present embodiment, the unequal-length angle shape is such that the lengths of the air passage inlet 15 and the air passage outlet 16, through which the air is passed at the small volume flow rate, are short, and the lengths of the combustion gas passage inlet 11 and the combustion gas passage outlet 12, through which the combustion gas is passed at the large volume flow rate, are long. Thus, it is possible to relatively reduce the flow rate of the combustion gas to more effectively avoid the generation of a pressure loss.

As can be seen from FIGS. 3 and 4, the outer housing 9 made of stainless steel is of a double structure comprised of outer wall members 28 and 29 and inner wall members 30 and 31 to define the air introducing duct 17. A front flange 32 bonded to rear ends of the front outer and inner wall members 28 and 30 is coupled to a rear flange 33 bonded to front ends of the rear outer and inner wall members 29 and 31 by a plurality of bolts 34. At this time, an annular seal member 35 which is E-shaped in section is clamped between the front and rear flanges 32 and 33 to seal the coupled surfaces of the front and rear flanges 32 and 33, thereby preventing the air within the air introducing duct 17 from being mixed with the combustion gas within the combustion gas introducing duct 13.

The heat exchanger 2 is supported on the inner wall member 31 connected to the rear flange 33 of the outer housing 9 through a heat exchanger supporting ring 36 made of the same plate material under the trade name of "Inconel" as the heat exchanger 2. The inner wall member 31 bonded to the rear flange 33 can be considered substantially as a portion of the rear flange 33, because of its small axial dimension. Therefore, the heat exchanger supporting ring 36 can be bonded directly to the rear flange 33 in place of being bonded to the inner wall member 31. The heat exchanger supporting ring 36 is formed into a stepped shape in section and includes a first ring portion $\mathbf{36}_1$ bonded to the outer peripheral surface of the heat exchanger 2, a second ring portion $\mathbf{36}_2$ bonded to the inner peripheral surface of the inner wall member 31 and having a diameter larger than that of the first ring portion $\mathbf{36}_1$, and a connecting portion $\mathbf{36}_3$ which connects the first and second ring portions $\mathbf{36}_1$ and $\mathbf{36}_2$ to each other in an oblique direction. The combustion gas passage inlet 11 and the air passage inlet 15 are sealed from each other by the heat exchanger supporting ring 36.

The profile of temperature on the outer peripheral surface of the heat exchanger 2 is such that the temperature is lower on the side of the air passage inlet 15 (on the axially rear side) and higher on the side of the combustion gas passage inlet 11 (on the axially front side). By mounting the heat exchanger supporting ring 36 at a location closer to the air passage inlet 15 than to the combustion gas passage inlet 11, the difference between the amounts of thermal expansion of the heat exchanger 2 and the outer housing 9 can be maintained to the minimum to decrease the thermal stress. When the heat exchanger 2 and the rear flange 33 are displaced relative to each other due to the difference between the amounts of thermal expansion, such displacement can be absorbed by the resilient deformation of the heat exchanger supporting ring 36 made of plate material, thereby alleviating the thermal stress acting on the heat exchanger 2 and the outer housing 9. Particularly, since the section of the heat exchanger supporting ring 36 is formed in the stepped configuration, the folded portions thereof can easily be deformed to effectively absorb the difference between the amounts of thermal expansion.

A second embodiment of the present invention will now be described with reference to FIGS. 13 to 17.

A heat exchanger 2 is formed into a rectangular parallelepiped shape as a whole and surrounded by an upper bottom wall 41 and a lower bottom wall 42, a front end wall 43 and a rear end wall 44, and a left sidewall 45 and a right sidewall 46. The combustion gas passage inlet 11 and the combustion gas passage outlet 12 extending laterally open into front and rear portions of the upper bottom wall 41, respectively, and the air passage inlet 15 and the air passage outlet 16 extending laterally open into rear and front portions of the lower bottom wall 42, respectively. The first rectangular heat-transfer plates S1 and the second rectangular heat-transfer plates S2 are alternately disposed within the heat exchanger 2 and formed by folding the folding plate blank 21 in a zigzag fashion along the crest-folding lines $L_1$ and the valley-folding lines $L_2$.

The combustion gas passages 4 connected to the combustion gas passage inlet and outlet 11 and 12 and the air passages 5 connected to the air passage inlet and outlet 15 and 16 are alternately defined between the first and second heat-transfer plates S1 and S2. At this time, the distances between the first and second heat-transfer plates S1 and S2 are maintained constant by brazing a plurality of first projections 22 and a plurality of second projections 23 formed on the first and second heat-transfer plates S1 and S2 at their tip ends to each other.

The folding plate blank 21 is brazed to the upper bottom wall 41 at the crest-folding lines $L_1$ and to the lower bottom wall 42 at the valley-folding lines $L_2$. Shorter portions (i.e., front and rear ends) of the first and second heat-transfer plates S1 and S2 are folded through an angle slightly smaller than 90° to form the rectangular flange portions 26. The flange portions 26 are superposed one on another and brazed to one another in surface contact to form the bonding flange 27 rectangular as a whole. The bonding flange 27 is bonded to each of the front end wall 43 and the rear end wall 44 by brazing. A gap between the bonding flange 27 and each of the front and rear end walls 43 and 44 is closed by a brazing material (see FIG. 17). By brazing the flange portions 26 formed by folding the ends of the first and second heat-transfer plates S1 and S2 to one another in the above manner, a precise cutting treatment of the ends of the first and second heat-transfer plates S1 and S2 is not required. Therefore, the brazing of the first and second projections 22 and 23 and the brazing of the flange portions 26 can be accomplished in a continuous flow, and moreover, because the flange portions 26 in surface contact with one another are brazed together, the brazing strength is increased remarkably.

Figure 14:
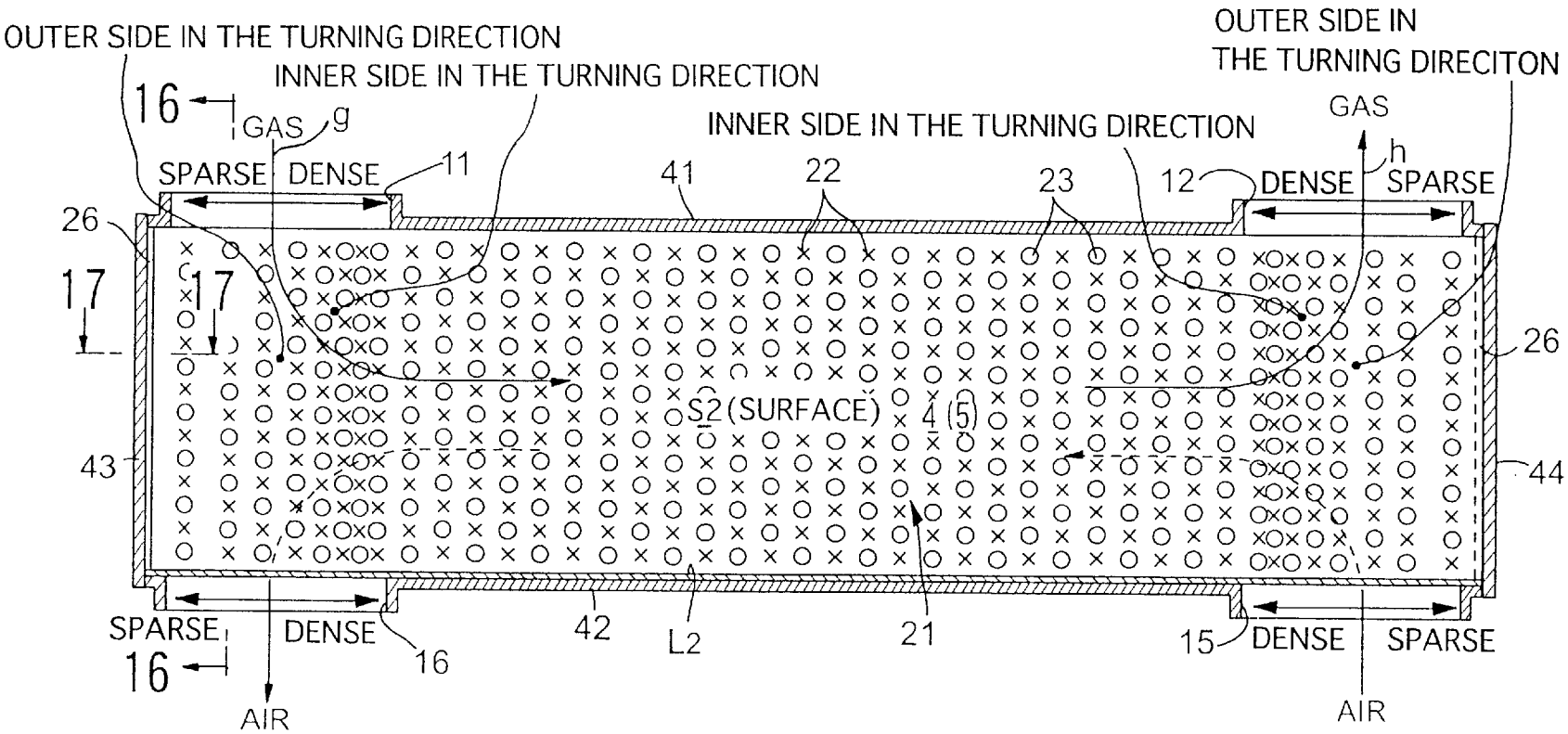
Figure 15:
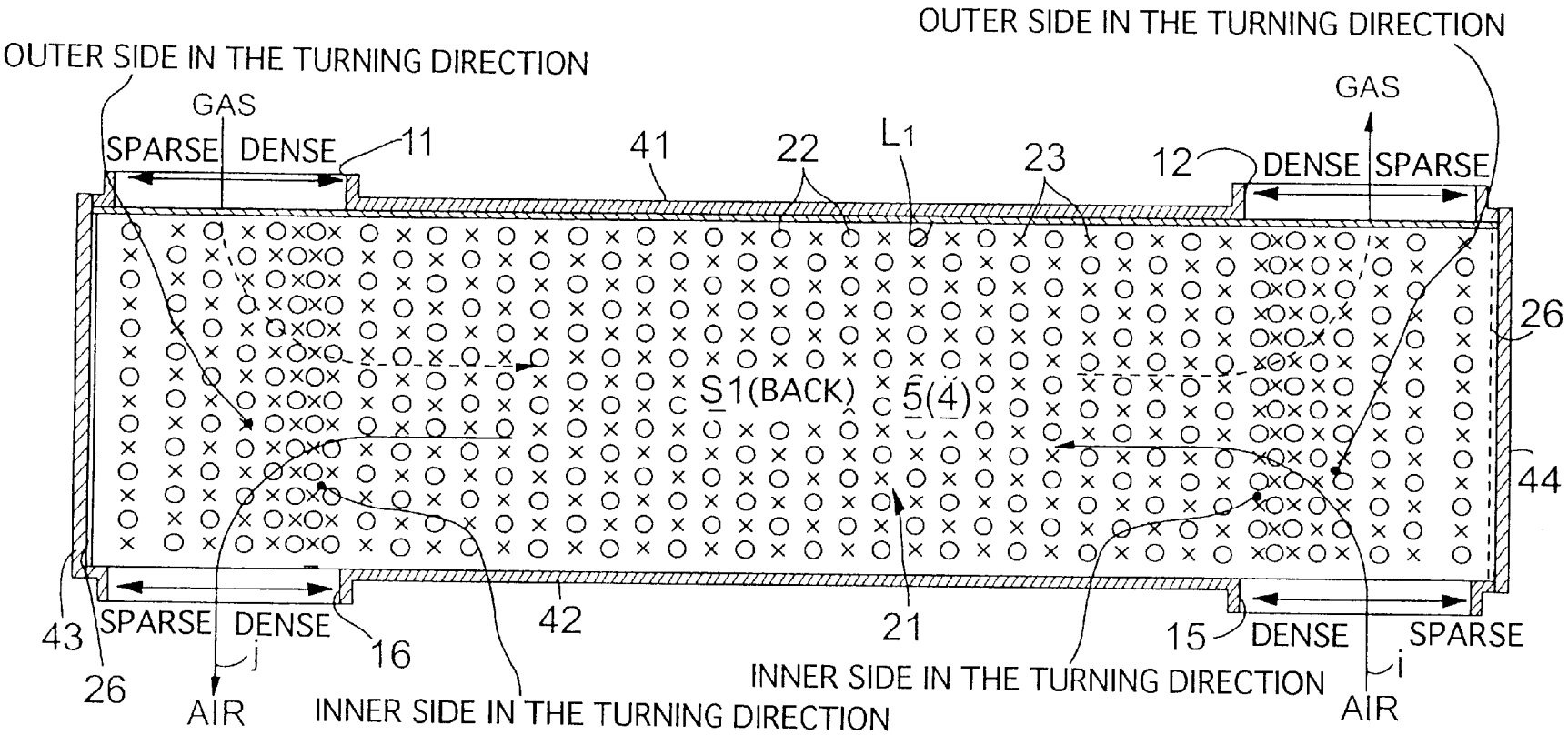
Figure 16:
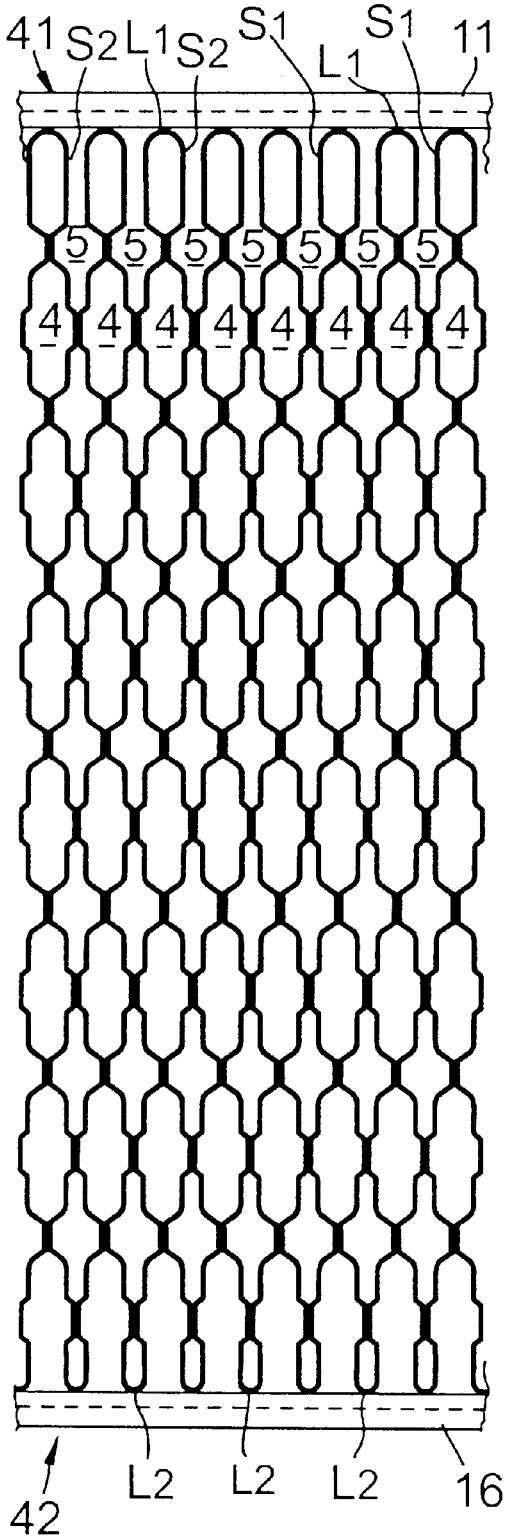
Figure 17:
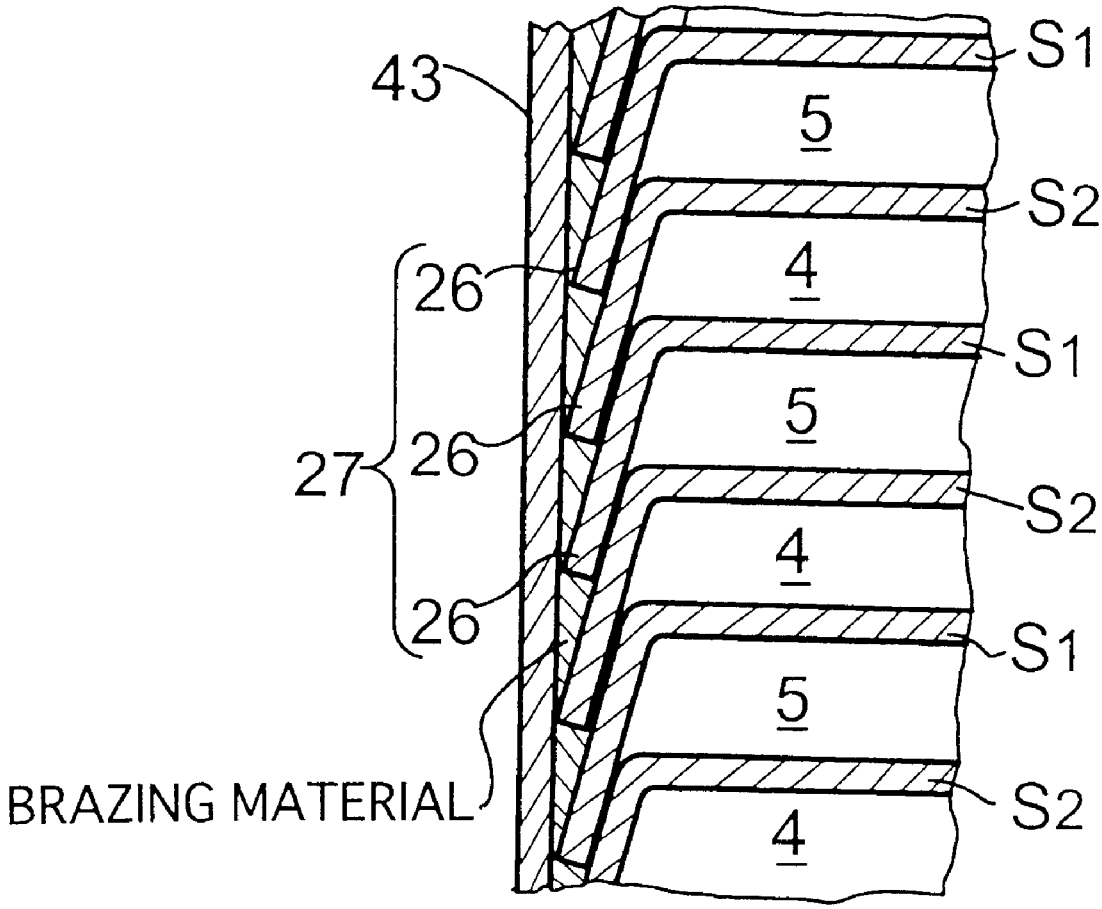

As shown in FIGS. 14 and 15, the arrangement of the first projections 22 and the second projections 23 formed in the first heat-transfer plates S1 and the second heat-transfer plates S2 is different between the longitudinally intermediate portion and the longitudinally opposite end portions (the areas facing the combustion gas passage inlet 11 and the air passage outlet 16 as well as the areas facing the combustion gas passage outlet 12 and the air passage inlet 15) of the first heat-transfer plates S1 and the second heat-transfer plates S2.

More specifically, the first and second projections 22 and 23 are arranged vertically at equal pitches and longitudinally at equal pitches in the longitudinally intermediate portions of the first and second heat-transfer plates S1 and S2. On the other hand, the first and the second projections 22 and 23 are arranged vertically at equal pitches in the longitudinally opposite end portions, but longitudinally at unequal pitches. Specifically, the pitch of longitudinal arrangement of the first and second projections 22 and 23 is denser at a location farther from the front ends in the areas facing the combustion gas passage inlet 11 and the air passage outlet 16, and denser at a location farther from the rear ends in the areas facing the combustion gas passage outlet 12 and the air passage inlet 15.

Therefore, when the combustion gas flowing into the heat exchanger through the combustion gas passage inlet 11 in the direction of an arrow g in FIG. 14 is turned at 90° in the direction along the combustion gas passages 4, the flow path resistance in the inner passage as viewed in the turning direction, where the combustion gas is easy to flow because of the short flow path, can be increased by the first and second projections 22 and 23 arranged in the denser relation, thereby uniformizing the flow rate of the combustion gas on the inner and outer sides as viewed in the turning direction. When the combustion gas flowing in the direction along the combustion gas passages 4 is turned at 90° to flow out through the combustion gas passage outlet 12 in the direction of an arrow h, the flow path resistance in the inner passage as viewed in the turning direction, where the combustion gas is easy to flow because of the shorter flow path, can be increased by the first and second projections 22 and 23 arranged in the denser relation, thereby uniformizing the flow rate of the combustion gas on the inner and outer sides as viewed in the turning direction.

Likewise, the air flowing into the heat exchanger through the air passage inlet 15 in the direction of an arrow i in FIG. 15 is turned at 90° in the direction along the air passages 5, the flow path resistance in the inner passage as viewed in the turning direction, where the air is easy to flow because of the short flow path, can be increased by the first and second projections 22 and 23 arranged in the denser relation, thereby uniformizing the flow rate of the combustion gas on the inner and outer sides as viewed in the turning direction. When the air flowing in the direction along the air passages 5 is turned at 90° to flow out through the air passage outlet 16 in the direction of an arrow j, the flow path resistance in the inner passage as viewed in the turning direction, where the air is easy to flow because of the shorter flow path, can be increased by the first and second projections 22 and 23 arranged in the denser relation, thereby uniformizing the flow rate of the air on the inner and outer sides as viewed in the turning direction.

A modification to the above-described first embodiment will now be described with reference to FIGS. 18 to 21.

Figure 18:
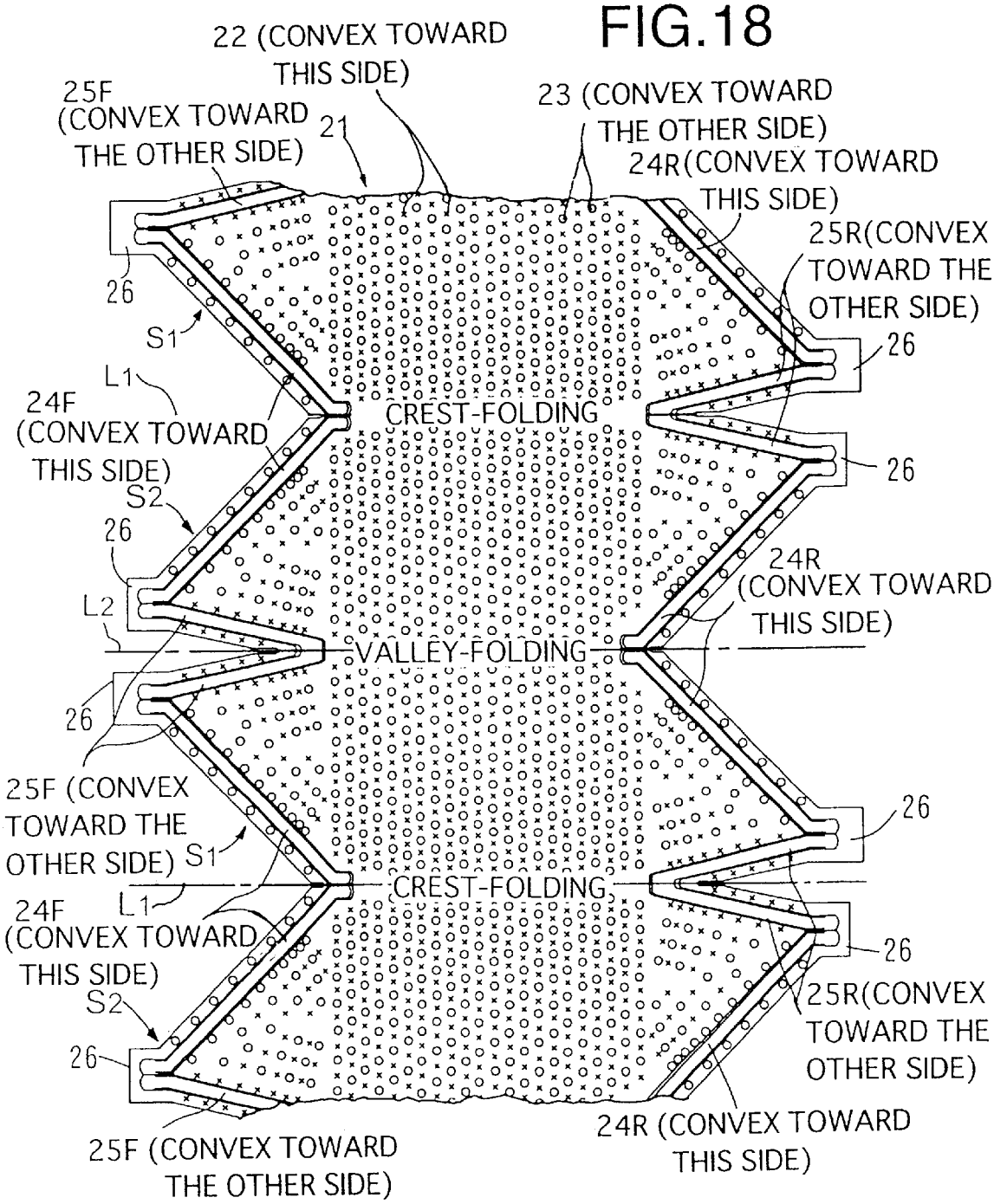
Figure 19:
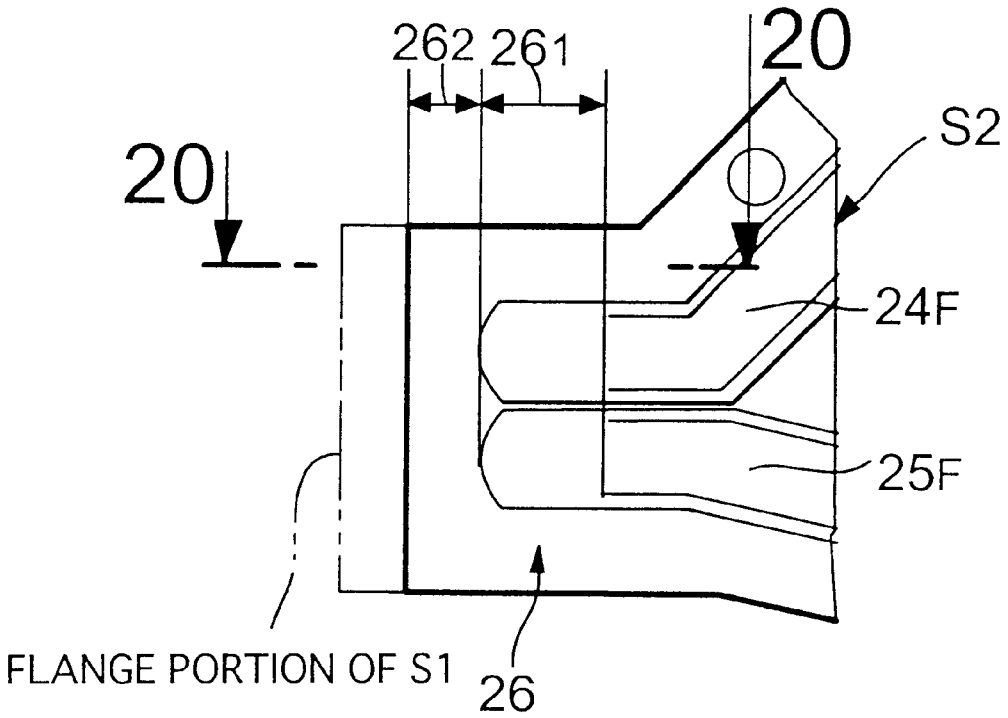
Figure 20:
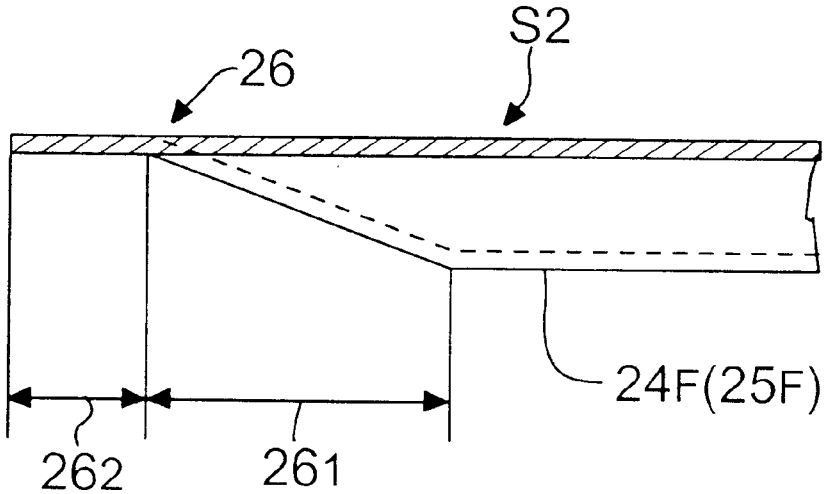

As shown in FIG. 18, in the first and second heat-transfer plates S1 and S2 of the folding plate blank 21, the shape of the flange portion 26 at an apex of an angle shape is slightly different from that in the first embodiment. FIGS. 19 and 20 show the shape of the flange portion 26 of the first heat-transfer plate S1. The flange portion 26 is comprised of a folded portion $\mathbf{26}_1$ in which the height of the first projection stripe $\mathbf{24}_F$ as well as the second projection stripe $\mathbf{25}_F$ is gradually decreased, and a flat portion $\mathbf{26}_2$ connected to a tip end of the folded portion $\mathbf{26}_1$. The length of the flat portion $\mathbf{26}_2$ is long in the first heat-transfer plate S1 and shorter in the second heat-transfer plate S2 (see FIG. 18).

Figure 21:
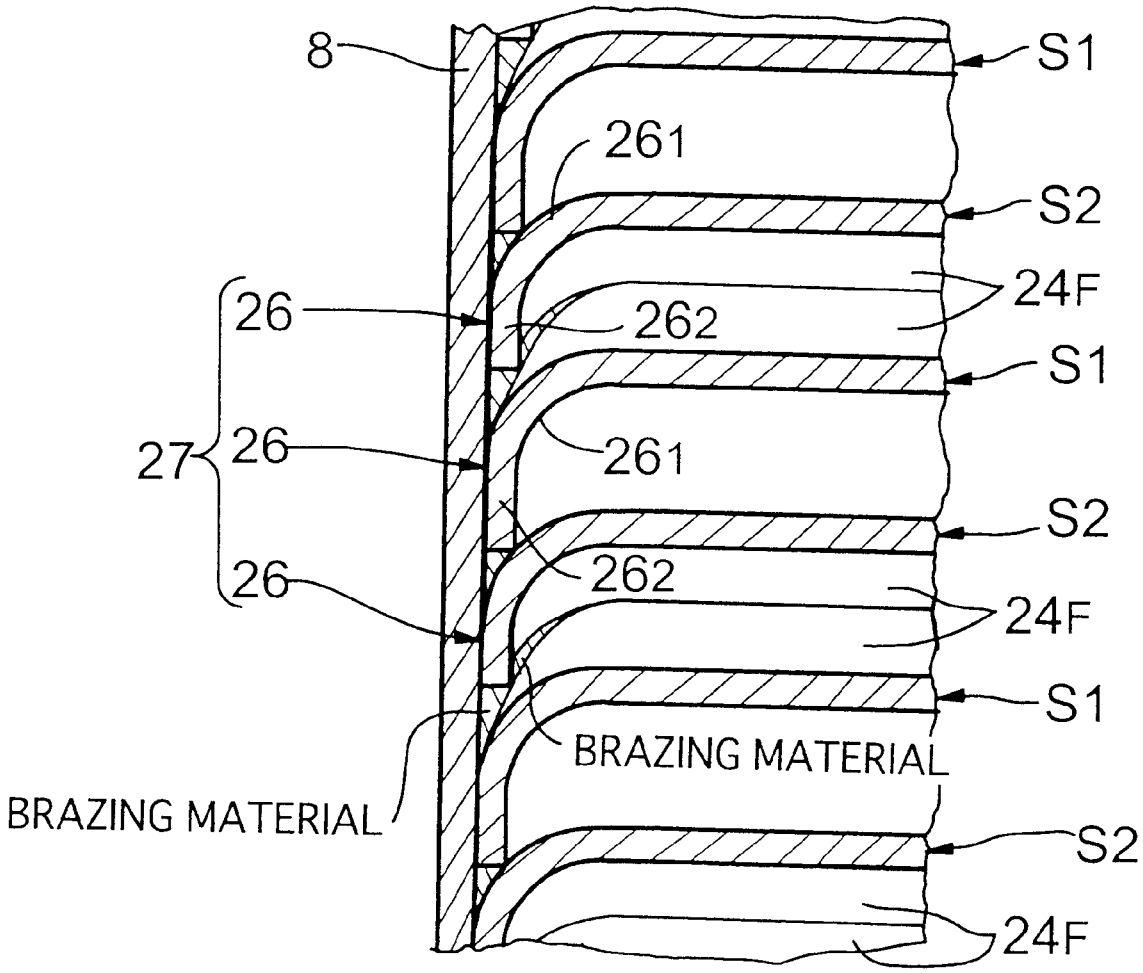

Thus, as can be seen from FIG. 21, each of the flange portions 26 of the first and second heat-transfer plates S1 and S2 is folded into an arcuate shape over 90° in a section of the folded portion $\mathbf{26}_1$, and the flat portion $\mathbf{26}_2$ is brazed in surface contact to the end plate 8. At this time, when the fist projection stripes $\mathbf{24}_F$ or the second projection stripes $\mathbf{25}_F$ are brazed to one another, the gap therebetween can be maintained to the minimum, because the height of the first and second projection stripes $\mathbf{24}_F$ and $\mathbf{25}_F$ is gradually decreased at the folded portion $\mathbf{26}_1$. Moreover, the length of the flat portion $\mathbf{26}_2$ of the flange portion 26 of the second heat-transfer plate S2 is short and hence, the tip end of the flat portion $\mathbf{26}_2$ cannot interfere with the first and second projection stripes $\mathbf{24}_F$ and $\mathbf{25}_F$ of the adjacent first heat-transfer plate S1, whereby the generation of the gap is further effectively prevented. The flange portions 26 on one side of the first and second heat-transfer plates S1 and S2 are shown in FIGS. 19 to 21, but the flange portions 26 on the other side are of the same structure as those on the one side.

According to such modification, the gap produced between the abutments of the first projection stripes $\mathbf{24}_F$ as well as between the abutments of the second projection stripes $\mathbf{25}_F$ can be maintained to the minimum, thereby enhancing the sealability to the fluid.

Although the embodiments of the present invention have been described in detail, it will be understood that the present invention is not limited to the above-described embodiments, and various modifications may be made without departing from the spirit and scope of the invention defined in claims.

For example, in the invention according to claims 1 to 11, the first and second heat-transfer plates S1 and S2 may be formed from different materials and bonded to each other, in place of use of the folding plate blank 21. In the invention according to claim 12, the opposite ends of the folding plate blank 21 may be bonded to each other at a location corresponding to the second folding line $L_2$, in place of being bonded to each other at the location corresponding to the first folding line

What is claimed is:

1. A heat exchanger, comprising a plurality of first heat-transfer plates (S1) and a plurality of second heat-transfer plates (S2) disposed radiately in an annular space defined between a radially outer peripheral wall (6) and a radially inner peripheral wall (7), and a high-temperature fluid passage (4) and a low-temperature fluid passage (5) which are defined circumferentially alternately between adjacent ones of said first and second heat-transfer plates (S1 and S2) by bonding pluralities of projections (22 and 23) formed on said first and second heat-transfer plates (S1 and S2) to one another, axially opposite ends of each of said first and second heat-transfer plates (S1 and S2) being cut into angle shapes each having two end edges with an apex portion disposed between and projecting from the two end edges, thereby defining a high-temperature fluid passage inlet (11) by closing one of said two end edges and opening the other end edge at axially one end of said high-temperature fluid passage (4), and defining a high-temperature fluid passage outlet (12) by closing one of said two end edges and opening the other end edge at the axially other end of said high-temperature fluid passage (4), defining a low-temperature fluid passage outlet (16) by opening one of said two end edges and closing the other end edge at axially one end of said low-temperature fluid passage (5), and defining a low-temperature fluid passage inlet (15) by opening one of said two end edges and closing the other end edge at the axially other end of said low-temperature fluid passage (5), each of the first and second heat-transfer plates having a first flange portion and a second flange portion disposed opposite the first flange portion, each of the first and second flange portions being respective folded ones of the apex portions of the angle shape, respective first and second flanges sized and folded to be superposed one on another and bonded together, wherein said high-temperature fluid passage inlet (11) and said low-temperature fluid passage outlet (16) are partitioned from each other in fluidic isolation by said superposed first flange portions (26) being disposed therebetween and wherein said high-temperature fluid passage outlet (12) and said low-temperature fluid passage inlet (15) are partitioned from each other in fluidic isolation by the superposed second flange portions (26 disposed therebetween.

2. A heat exchanger according to claim 1, characterized in that a folding plate blank (21) including said first and second heat-transfer plates (S1 and S2) which are alternately connected together through first and second folding lines ($L_1$ and $L_2$) is folded in a zigzag fashion along said first and second folding lines ($L_1$ and $L_2$), and portions corresponding to said first folding lines ($L_1$) are bonded to said radially outer peripheral wall (6), while portions corresponding to said second folding lines ($L_2$) are bonded to said radially inner peripheral wall (7).

3. A heat exchanger according to claim 1, characterized in that said flange portions (26) are folded into an arcuate shape and superposed one on another, and a height of projection stripes ($\mathbf{24}_F$, $\mathbf{24}_R$, $\mathbf{25}_F$ and $\mathbf{25}_R$) formed along angle-shaped end edges of said first and second heat-transfer plates (S1 and S2) is gradually decreased in said flange portions (26) in order to close said fluid passage inlets and outlets (11, 12, 15 and 16).

4. A heat exchanger, comprising a plurality of first heat-transfer plates and a plurality of second heat-transfer plates which are disposed radiately in an annular space defined between a radially outer peripheral wall and a radially inner peripheral wall, wherein a high-temperature fluid passage and a low-temperature fluid passage are defined alternately in a circumferential direction between adjacent ones of said first and second heat-transfer plates, axially opposite ends of each of said first and second heat-transfer plates being cut into an angle shape each having two end edges, respectively, thereby defining a high-temperature fluid passage inlet by closing one of said two end edges and opening the other end edge at axially one end of said high-temperature fluid passage, and defining a high-temperature fluid passage outlet by closing one of said two end edges and opening the other end edge at the axially other end of said high-temperature fluid passage, defining a low-temperature fluid passage outlet by opening one of said two end edges and closing the other end edge at axially one end of said low-temperature fluid passage, and defining a low-temperature fluid passage inlet by opening one of said two end edges and closing the other end edge at the axially other end of said low-temperature fluid passage, and tip ends of large numbers of projections formed on opposite surfaces of the first and second heat-transfer plates being brazed together, characterized in that an arrangement of pitches of said projections is different between axially opposite ends and an axially intermediate portion of each of said first and second heat-transfer plates, and in areas facing said inlets and outlets of said high-temperature fluid passage and said low-temperature fluid passage, said arrangement of pitches of said projections in a direction substantially perpendicular to the direction of flowing of fluid passed through said inlets and outlets is dense in an area portion nearer to a base end portion of the angle shape and sparse in an area portion nearer to a tip end portion.

5. A heat exchanger, comprising a plurality of first heat-transfer plates and a plurality of second heat-transfer plates which are disposed radiately in an annular space defined between a radially outer peripheral wall and a radially inner peripheral wall, wherein a high-temperature fluid passage and a low-temperature fluid passage are defined alternately in a circumferential direction between adjacent ones of said first and second heat-transfer plates, axially opposite ends of each of said first and second heat-transfer plates being cut into an angle shape each having two end edges, respectively, thereby defining a high-temperature fluid passage inlet by closing one of said two end edges and opening the other end edge at axially one end of said high-temperature fluid passage, and defining a high-temperature fluid passage outlet by closing one of said two end edges and opening the other end edge at the axially other end of said high-temperature fluid passage, defining a low-temperature fluid passage outlet by opening one of said two end edges and closing the other end edge at axially one end of said low-temperature fluid passage, and defining a low-temperature fluid passage inlet by opening one of said two end edges and closing the other end edge at the axially other end of said low-temperature fluid passage, and tip ends of large numbers of projections formed on opposite surfaces of the first and second heat-transfer plates being brazed together, characterized in that an arrangement of pitches of said projections is different between axially opposite ends and an axially intermediate portion of each of said first and second heat-transfer plates, and said arrangement of pitches of said projections is set such that the unit number of heat transfer is substantially constant in a radial direction at the axially intermediate portion of said first and second heat-transfer plates.

6. A heat exchanger, comprising a plurality of first heat-transfer plates and a plurality of second heat-transfer plates which are disposed radiately in an annular space defined between a radially outer peripheral wall and a radially inner peripheral wall, wherein a high-temperature fluid passage and a low-temperature fluid passage are defined alternately in a circumferential direction between adjacent ones of said first and second heat-transfer plates, axially opposite ends of each of said first and second heat-transfer plates being cut into an angle shape each having two end edges, respectively, thereby defining a high-temperature fluid passage inlet by closing one of said two end edges and opening the other end edge at axially one end of said high-temperature fluid passage, and defining a high-temperature fluid passage outlet by closing one of said two end edges and opening the other end edge at the axially other end of said high-temperature fluid passage, defining a low-temperature fluid passage outlet by opening one of said two end edges and closing the other end edge at axially one end of said low-temperature fluid passage, and defining a low-temperature fluid passage inlet by opening one of said two end edges and closing the other end edge at the axially other end of said low-temperature fluid passage, and tip ends of large numbers of projections formed on opposite surfaces of the first and second heat-transfer plates being brazed together, characterized in that an arrangement of pitches of said projections is different between axially opposite ends and an axially intermediate portion of each of said first and second heat-transfer plates, and said projections are arranged at the axially intermediate portion of each of said first and second heat-transfer plates, so as not to line up in the direction of flowing of fluid passed through said axially intermediate portion.

* * * * *